US005971383A

United States Patent [19]

Horikawa et al.

[11] Patent Number: 5,971,383

[45] Date of Patent: Oct. 26, 1999

[54] FINISHER WITH A LARGE-CAPACITY SHEET STACK SECTION

[75] Inventors: Masayoshi Horikawa, Toyokawa; Hiroyuki Yoshikawa, Aichi-Ken; Kazuyuki Tomishige, Toyohashi, all of Japan

[73] Assignee: Minolta Co., Ltd., Osaka, Japan

[21] Appl. No.: 08/855,534

[22] Filed: May 13, 1997

[30] Foreign Application Priority Data

May 14, 1996 [JP] Japan ..... 8-118863

[51] Int. Cl.[6] ..... B65H 39/042

[52] U.S. Cl. ..... 270/58.11; 270/58.08; 270/58.13; 271/298; 271/303

[58] Field of Search ..... 270/58.08, 58.11, 270/58.12, 58.13, 58.4, 58.28; 399/410; 271/293, 294, 298, 302, 303

[56] References Cited

U.S. PATENT DOCUMENTS

| | | | |
|---|---|---|---|
| 4,350,333 | 9/1982 | Landa . | |
| 4,449,812 | 5/1984 | Furuichi et al. | 271/294 X |
| 5,020,784 | 6/1991 | Asami et al. . | |
| 5,114,130 | 5/1992 | Hamanaka et al. | 270/58.11 |
| 5,121,911 | 6/1992 | Yamazaki et al. | 270/58.13 |
| 5,177,548 | 1/1993 | Nakamura et al. | 270/58.08 |
| 5,201,530 | 4/1993 | Matsui et al. | 270/58.14 |
| 5,362,200 | 11/1994 | Ushirogata | 271/293 X |
| 5,374,043 | 12/1994 | Mandel et al. | 270/58.14 |
| 5,407,186 | 4/1995 | Hayama et al. | 270/58.13 |
| 5,580,039 | 12/1996 | Takehara et al. | 270/58.11 |
| 5,709,376 | 1/1998 | Ushirogata | 270/58.11 |

FOREIGN PATENT DOCUMENTS

| | | |
|---|---|---|
| 59-26857 | 2/1984 | Japan . |
| 59-26857 | 5/1984 | Japan . |
| 61-243465 | 10/1986 | Japan . |

*Primary Examiner*—William E. Terrell
*Assistant Examiner*—Patrick Mackey
*Attorney, Agent, or Firm*—Burns, Doane, Swecker & Mathis, LLP

[57] ABSTRACT

A staple sorter which distributes sheets ejected from a copying machine into a plurality of bins and staples stacks of sheets in the bins by use of a staple unit. The bins are vertically movable pitch by pitch, and a large-capacity tray is provided above the bins. A sheet conveyer gate which has rollers, is vertically movable between the bins and the tray. When the sheet conveyer gate is in a lowered position, the rollers take a stapled stack of sheets out of a bin. Then, the sheet conveyer gate is raised and takes the stack of sheets into the large-capacity tray.

20 Claims, 33 Drawing Sheets

10
SE33
102
M20
M50
SE22
SE23
M21
SL50
20
84
103
SE20
82
81
SE34
100
85
101
82a
80
83
21
86
120
X3
X2
X1
40a
Y2
Y3
SE53
87
SE21
31 1
31 2
31 3
92
90
40
93
95
91
32
94
71
34
31 18
31 19
31 20
72
70
30
34
M60
32

FINISHER WITH A LARGE-CAPACITY SHEET STACK SECTION

BACKGROUND OF THE INVENTION

1. Field of the Invention

The present invention relates to a finisher, and more particularly to a finisher which stacks sheets ejected from a copying machine or a printer and performs a process such as stapling and binding toward the stacked sheets.

2. Description of Related Art

Generally, an image forming apparatus such as an electrophotographic copying machine and a laser printer is provided with a finisher which sorts image-formed sheets and staples the sheets. A well-known type of this kind of finisher is one disclosed by Japanese Patent Publication No. 5-37315, wherein sheets are stacked and stapled on an inclined tray, and the lower part of the tray is opened to drop the stapled stack of sheets into a stack section under the tray. However, dropping the stapled stack of sheets into the stack section makes a noise, thereby affecting the office environment.

On the other hand, Japanese Patent Publication No. 4-66786 disclosed a sorter, wherein a stack bin is provided above a plurality of sort bins, and stacks of sheets are conveyed from the sort bins to the stack bin. This sorter does not make a noise when a stack of sheets is conveyed into the stack bin.

However, in this sorter, since sheet stack conveying means for conveying a stack of sheets into the stack bin is provided at a rear side of the sort bins, that is, the opposite side of the entrances of the sort bins, a space for the sheet stack conveying means itself and for its movement is necessary, thereby increasing the size of the apparatus.

Also, in the above-mentioned finisher, since the stack section is exclusively used for storing stapled stacks of sheets, a space for the stack section and a space for sheet stack take-out means are necessary, thereby increasing the size of the apparatus.

SUMMARY OF THE INVENTION

An object of the present invention is to provide a finisher which can convey a processed stack of sheets such as a stapled stack of sheets into a stack section without making a noise and can be downsized.

Another object of the present invention is to provide a finisher which is downsized by using a non-sort tray or the like also as a stack section.

In order to attain the objects, a finisher according to the present invention comprises: a process tray on which sheets are stacked to undergo the process; a stack section which is provided above the process tray to store sheets; and sheet stack conveying means which is provided adjacent to an entrance of the process tray and is vertically movable to take a processed stack of sheets out of the process tray and convey the stack of sheets to the stack section.

In this structure, a processed stack of sheets is taken out of the process tray and conveyed upward to the stack section by the sheet stack conveying means. The finisher is not the conventional type which drops a stack of sheets into a stack section, and a noise is never made. The sheet stack conveying means is located inside the body of the finisher, more specifically, adjacent to an entrance of the process tray, and is movable vertically. Accordingly compared with the conventional type wherein sheet stack conveying means is provided at the opposite side of the entrances of sort bins, the finisher can be downsized.

Further, in the finisher, when the sheet stack conveying means conveys a stapled stack of sheets, it is preferred that the stapled stack of sheets is taken out of the tray with its stapled end as a leading end. In this case, the stapled stack of sheets is received by the sheet stack conveying means smoothly. More specifically, the stapled end where the sheets are joined together easily comes into the sheet stack conveying means, and the end is not bent.

Also, it is preferred that the stapled stack of sheets is taken into the stack section with its unstapled end as a leading end. In this case, the staple which protrudes over the surface of the stack is located at the side of the sheet stack conveying means in the stack section, and there is no fear that the unstapled end of a stapled stack of sheets which is conveyed to the stack section next may catch on the staple.

BRIEF DESCRIPTION OF THE DRAWINGS

These and other objects and features of the present invention will become apparent from the following description with reference to the accompanying drawings, in which.

DETAILED DESCRIPTION OF THE PREFERRED EMBODIMENTS

Hereinafter, an embodiment of this finisher in accordance with the present invention will be described referring to the appended drawings. In the embodiment to be described below, the present invention is applied to a staple sorter connected to a n electrophotographic copying machine.

Figure 1:
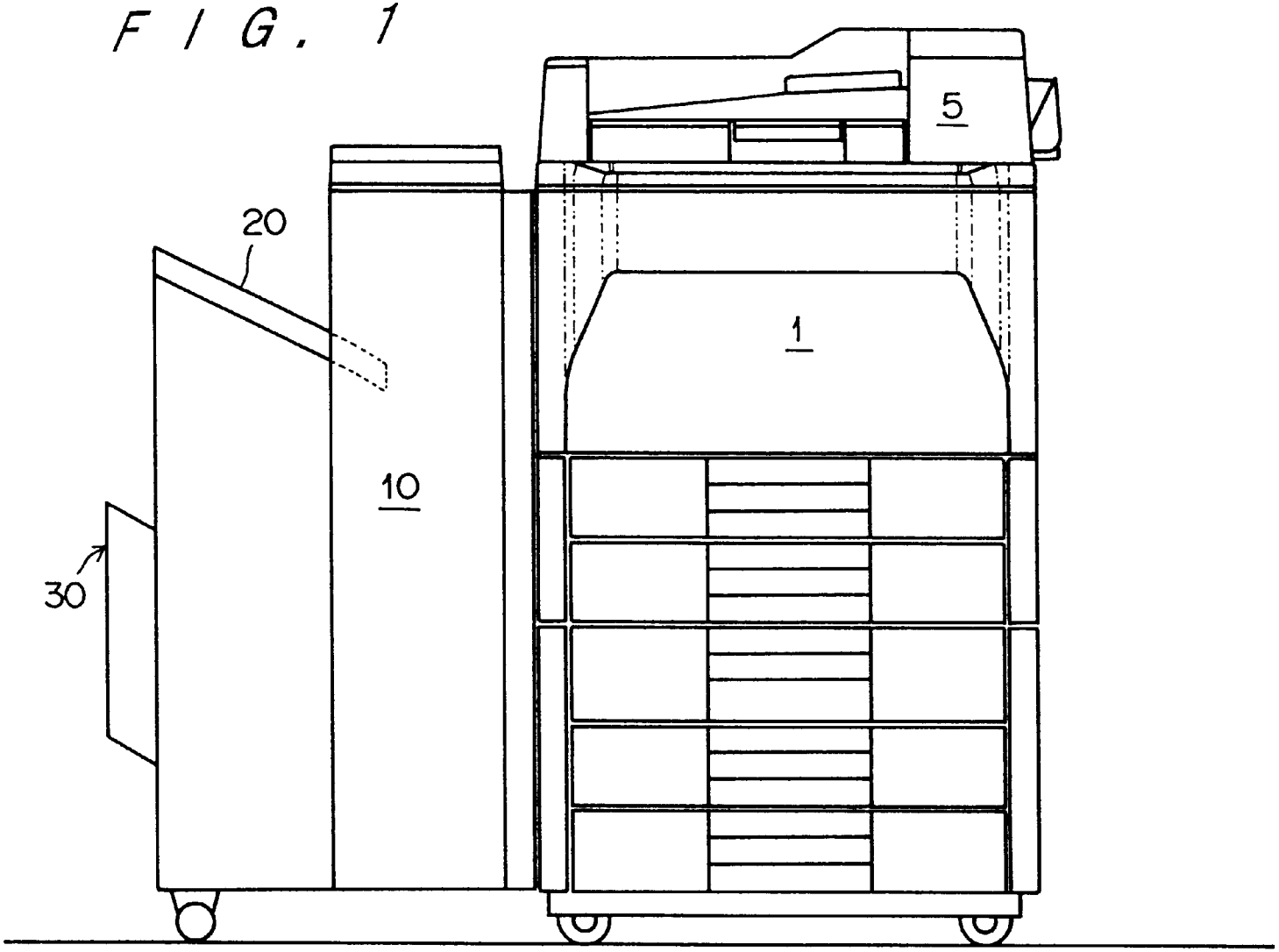
FIG. 1 is a front view illustrating the appearance of a staple sorter in accordance with an embodiment of the invention and a copying machine.

In FIG. 1, the reference numerals 1 and 10 denote an electrophotographic copying machine and a staple sorter, respectively. The copying machine 1 forms an image on sheets by the well-known electrophotographic method and has an automatic recirculating document feeder 5 on its top. The automatic document feeder 5 delivers a stack of original documents on a tray sequentially onto a platen glass, and ejects the documents which have been exposed to light at the number of times equal to the number of copies (registered number) specified by the operator, from the platen glass onto the tray. When it is necessary to make additional copies of the stack of documents after one circulation, the documents are cyclically fed for the second and the third circulation. Besides, the automatic document feeder 5 has a function of counting the number of the fed documents.

Figure 2:
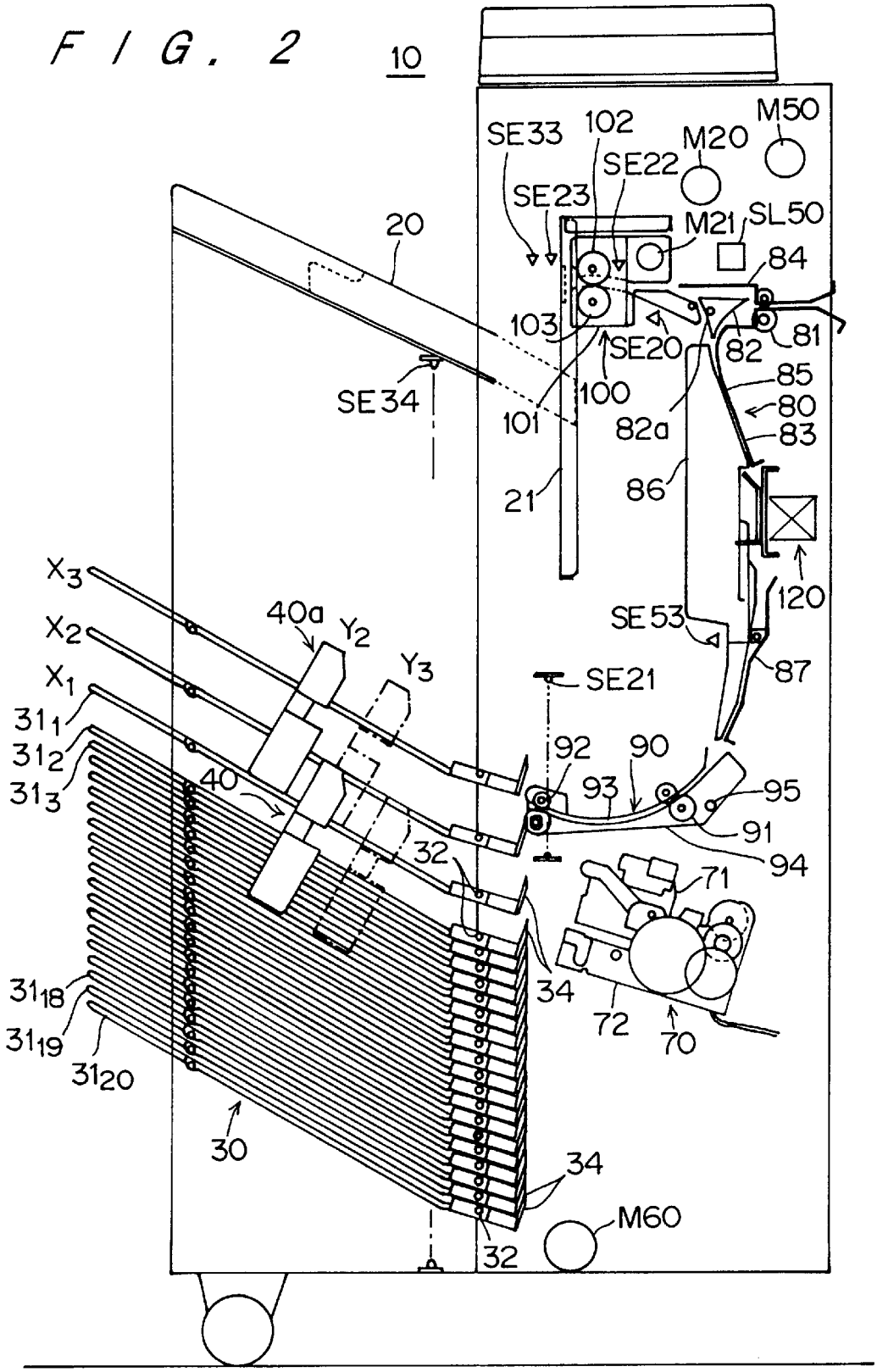
FIG. 2 is a schematic representation illustrating the staple sorter.

As shown in FIG. 2, the staple sorter 10 generally comprises a large-capacity non-sort tray 20, a bin assembly 30 having a stack of twenty bins 31, chucking units 40 and 40*a* for pulling out a stack of sheets stored in each bin 31, a staple unit 70, a sheet conveyer section 80 and a sheet conveyer gate 100.

The staple sorter 10 is capable of handling sheets ejected from the copying machine 1, on which images have been formed, in the following modes: a non-sort mode of stacking sheets on the non-sort tray 20 without sorting, a sort mode of making collated sets of sheets and delivering each set onto each bin 31, a sort/staple mode of stapling each collated set of sheets, a sort/stack mode of taking each of the stapled sets of sheets in the sort/staple mode out of each bin 31 and stacking the sets of sheets on the non-sort tray 20, a group mode of making sets of sheets each having the same page and delivering each set onto each bin 31, a group/staple mode of stapling each set of sheets having the same page, a group/stack mode of taking each of the staple sets of sheets in the group/staple mode out of each bin 31 and stacking the sets on the non-sort tray 20.

Next, the inner structure of the staple sorter 10 will be described in detail.

The sheet conveyer section 80 comprises a pair of receiving rollers 81 for receiving a sheet ejected from the copying machine 1, a diverter 82 for switching the direction in which the sheet is conveyed, a first conveyer section 83 extending vertically in general and a second conveyer section 90 extending horizontally in general from the first conveyer section 83 toward the bin assembly 30. The diverter 82 is so mounted as to pivot about a pin 82a according to the ON or OFF state of a solenoid SL50. When the solenoid SL50 is OFF, the diverter 82 is set at the position shown by the solid line in FIG. 2. At this time, a sheet received by the pair of receiving rollers 81 is guided by the curved surface on the right side of the diverter 82 and delivered into the first conveyer section 83. When the solenoid SL50 is turned on, the diverter 82 slightly pivots clockwise. At this time, a sheet is guided by the upper surface of the diverter 82 and delivered onto the non-sort tray 20 through the sheet conveying gate 100, which will be described below.

The first conveyer section 83 comprises guide plates 84, 85, 86, and 87, and the middle part of the section 83 is provided with a punching mechanism 120 for making binding holes in the leading or trailing portion of a sheet in its feeding direction. The details of the punching mechanism 120 are omitted herein.

The second conveyer section 90, comprising pairs of conveyer rollers 91 and 92, and guide plates 93 and 94, is capable of pivoting about a support shaft 95 within an angle of approximately 90 degrees. In the sort mode or the group mode, the second conveyor section 90 is set in its conveying position shown by the solid line in FIG. 2 to deliver a sheet sent from the first conveyer section 83 into each bin 31. In the handling for taking out sheets, which will be described below, the second conveyer section 90 pivots approximately 90° clockwise about the support shaft 95 and stands up (see FIGS. 6*a*–6*f*) to retreat from the sheet conveying position.

The sheet conveyer section 80 is provided with a transmission sensor SE21 for detecting a sheet and with a sensor SE53 for detecting the second conveyer section 90 set in the retreating position. The pairs of rollers 81, 91 and 92 are driven and rotated by a motor M50.

The bin assembly 30 comprises a stack of twenty bins $\mathbf{31}_1$–$\mathbf{31}_{20}$, and the bins 31 are disposed at uniform intervals with an inclination. A pin 32 provided at the lower end of each bin 31 is in engagement with a spiral groove formed on the outer circumferential surface of a vertical drive shaft (not shown). The drive shaft is rotated in forward/reverse directions by a motor M60, and one revolution of the drive shaft elevates or lowers each bin 31 by one pitch. The position of the bin assembly 30 which is shown in solid line in FIG. 2 is its lowest position (or its home position), at which the first bin $\mathbf{31}_1$ faces the staple unit 70. Hereinafter, the position of the first bin $\mathbf{31}_1$ at the time when the bin assembly 30 is set at the home position is referred to as level $X_1$. Then, one revolution (in forward direction) of the drive shaft elevates the first bin $\mathbf{31}_1$ to level $X_2$, at which a sheet is delivered into the bin $\mathbf{31}_1$ from the sheet conveyer section 80. Additional one revolution of the drive shaft elevates the first bin $\mathbf{31}_1$ to Level $X_3$, at which a stack of sheets is taken out of the bin $\mathbf{31}_1$. The handling of taking out a stack of sheets will be described in detail below.

The bin assembly 30 is provided with sensors (not shown) for detecting whether each bin 31 is set at the lowest position (the home position), with sensors (not shown) for detecting the elevation by one pitch of each bin 31 caused by one revolution of the drive shaft and with a transmission sensors SE34 for detecting the presence or absence of sheets on each bin 31.

The bin assembly 30 can be provided with a first and a second chucking units 40 and 40*a* for pinching a stack of sheets to pull the stack out of the bin 31 or to return the stack to the bin 31. The first chucking unit 40 is disposed in a position to handle a stack of sheets with respect to the bin 31 set at the level $X_1$. The second chucking unit 40*a* is disposed in a position to handle a stack of sheets with respect to the bin 31 set at the level $X_3$. As shown in FIG. 4, the chucking units 40 and 40*a* are mounted to a single movable frame 55 at different levels and are capable of moving along a guide groove 57 (see FIG. 3) integrally with the frame 55.

In the lower chucking unit 40 in FIG. 4, a pair of upper and lower chucking lugs 41 and 42, each having an elastic member 43, are connected via pins 45 and 48 to one end of links 44 and 47, respectively, and the links 44 and 47 are connected to a solenoid SL30. The links 44 and 47 are capable of pivoting about support shafts 46 and 49, respectively. The chucking lugs 41 and 42 are supported by a guide member not shown so that the lugs 41 and 42 can move upward and downward. When the solenoid SL30 is OFF, as shown in solid line in FIG. 4, the lug 41 is above a bin 31 set at the level $X_1$, while the lug 42 is just under the bin 31. When the solenoid SL30 is turned ON, the link 44 pivots counter-clockwise about the support shaft 46, and the link 47 pivots clockwise about the support shaft 49. The pivoting lowers the lug 41 and elevates the lug 42, and thus the lugs pinch a side portion of the stack of sheets on the bin 31. In a side portion of each bin 31 is formed a cutout 33 which permits the pinching by the lugs 41 and 42 and permits a stack of sheets to be moved by a predetermined distance.

The upper chucking unit 40*a*, which pinches the stack of sheets on a bin 31 set at the Level $X_3$, has the same structure as the lower chucking unit 40 mentioned above. In the drawing, like members are denoted by like reference numerals except that "a" is added to a reference numeral for the chucking unit 40*a*.

Figure 3:
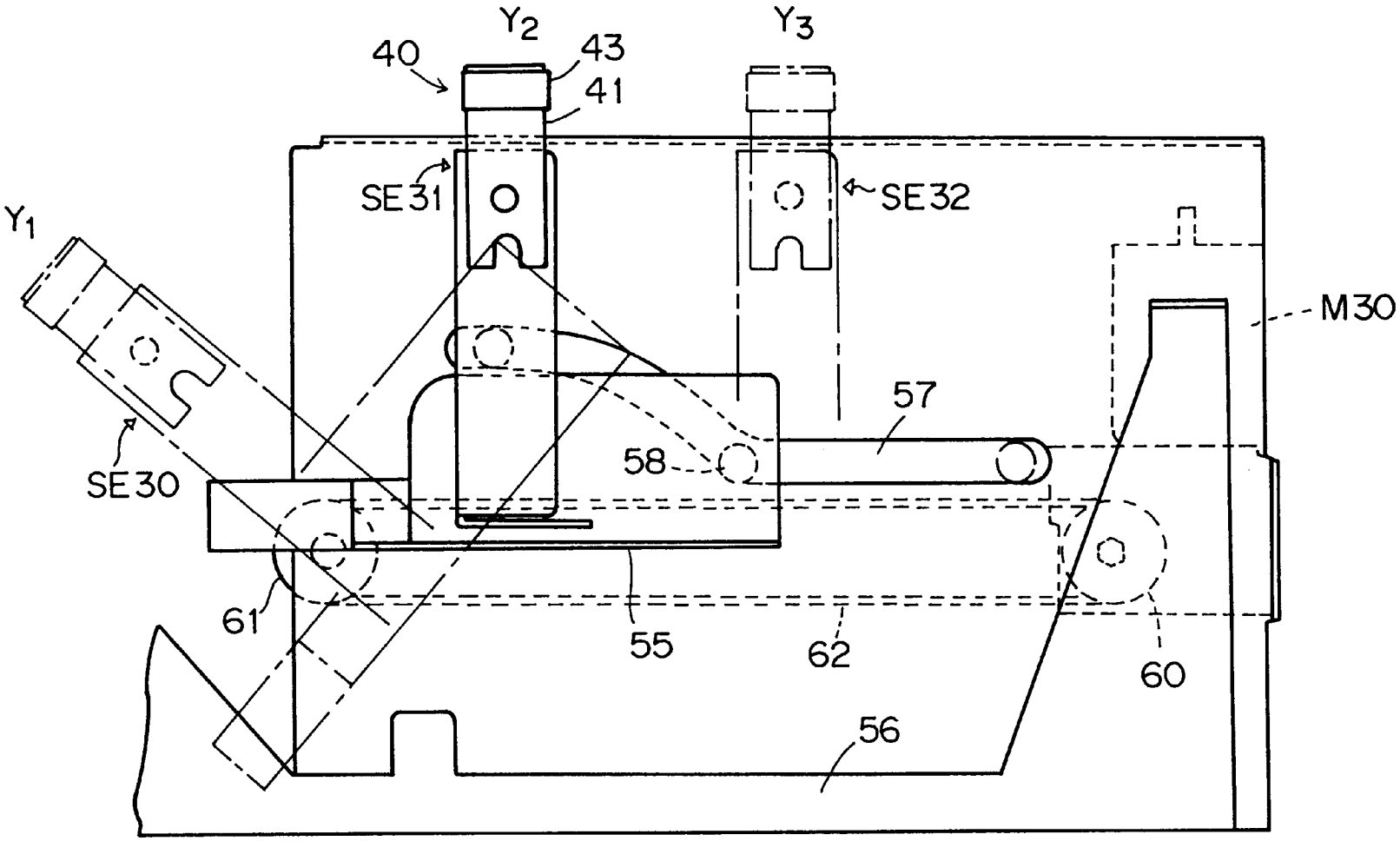
FIG. 3 is a plan view illustrating a chucking unit in the staple sorter.
Figure 4:
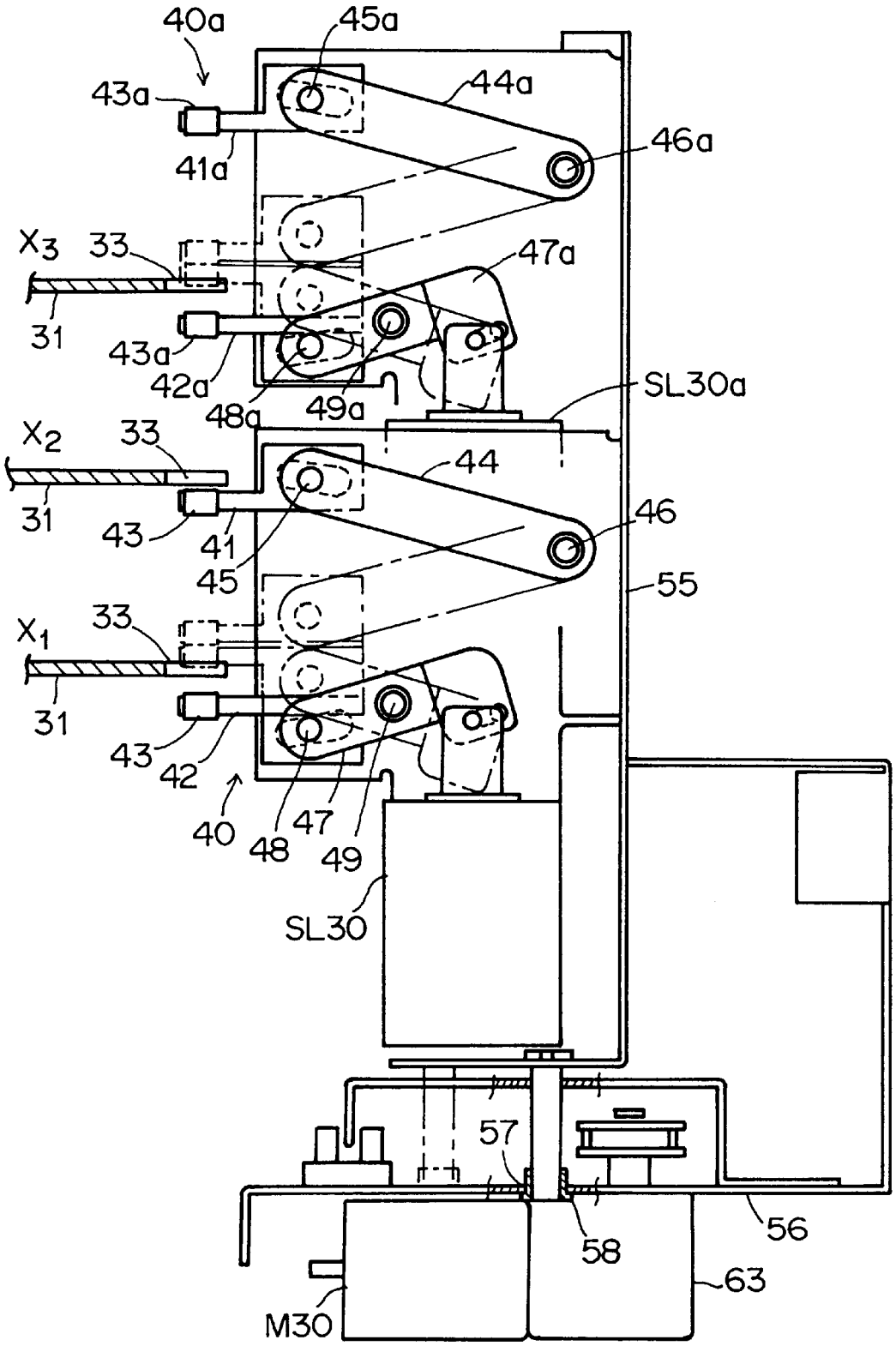
FIG. 4 is an elevational view, partly in section, illustrating the chucking unit.

As shown in FIG. 3, the chucking units 40 and 40*a* are capable of moving between a home position $Y_1$ to retreat from the bins 31, a chucking position $Y_2$ and a pulling-out position $Y_3$. For the movement, a guide groove 57 is formed in a fixed frame 56, and a roller 58 which is mounted to a movable frame 55 holding the chucking units 40 and 40*a* is in engagement with the guide groove 57.

In addition, a belt 62 is stretched endlessly between pulleys 60 and 61 provided rotatably in the fixed frame 56, and a portion of the belt 62 is connected to the movable frame 55. The pulley 60 is driven and rotated in forward/reverse direction through a reduction mechanism 63 by a motor M30 provided on the underside of the fixed frame 56. The guide groove 57 comprises a curved part and a straight part, and the chucking units 40 and 40*a* are set at the home position $Y_1$ when the roller 58 is positioned at the left end of the curved part (see FIG. 3). The clockwise rotation of the belt 62 caused by the forward operation of the motor M30 causes the roller 58 to move right in the curved part and causes the chucking units 40 and 40*a* to move along an arc. When the roller 58 reaches the boundary point between the curved part and the straight part, the chucking units 40 and 40*a* are at the chucking position $Y_2$. The chucking units 40 and 40*a* pinch a stack of sheets at this position $Y_2$. The additional forward operation of the motor M30 causes the roller 58 to move right in the straight part and to reach the right end of the straight part, and then the motor M30 is stopped. Simultaneously, the chucking units 40 and 40*a* move to the pulling-out position $Y_3$. Thus, the stack of sheets are conveyed by the distance between $Y_2$ and $Y_3$, and pulled out of the bin 31 (see FIG. 6*b*). At the level $X_1$, the pulling-out position $Y_3$ is the position where the staple unit 70 performs stapling; at the level $X_3$, the position $Y_3$ is where the sheet conveyer gate 100 which will be described below receives a stack of sheets.

To the lower end of each bin 31 is attached a stopper 34 for regulating the lower edges of the sheets stacked on the bin 31. At all times, each stopper 34 is set in the stand-up position shown in solid line in FIG. 2 by a spring member not shown. To the chucking units 40 and 40*a* are mounted rods not shown, which allow a stack of sheets to be taken out of the bin 31. A tip of the rod lays down the stopper 34 when the chucking units 40 and 40*a* move from the chucking position $Y_2$ to the pulling-out position $Y_3$.

Additionally, there are provided a sensor SE30 for detecting the chucking units 40 and 40*a* set in the home position $Y_1$, a sensor SE31 for detecting the chucking units 40 and 40*a* moved to the chucking position $Y_2$, and a sensor SE32 for detecting the chucking units 40 and 40*a* moved to the pulling-out position $Y_3$.

The chucking units 40 and 40*a* having the above structure move in the same direction along the positions $Y_1$-$Y_2$-$Y_3$ to convey stacks of sheets from the bins 31 set at the levels $X_1$ and $X_3$ respectively. Accordingly, means for guiding the movement (such as the guide groove 57) requires only a single structure and can be simplified. Furthermore, the driving mechanism for the chucking units 40 and 40*a* can be simplified because the mechanism requires only the single motor M30. Besides, each of the pairs of chucking lugs 41 and 42, and 41*a* and 42*a* is coaxially arranged in each of the chucking units 40 and 40*a*, so that there are provided a good performance on pinching a stack of sheets and a good operability by the solenoids SL30 and SL30*a*.

In the following, the sheet conveyer gate 100 will be described.

Figure 5:
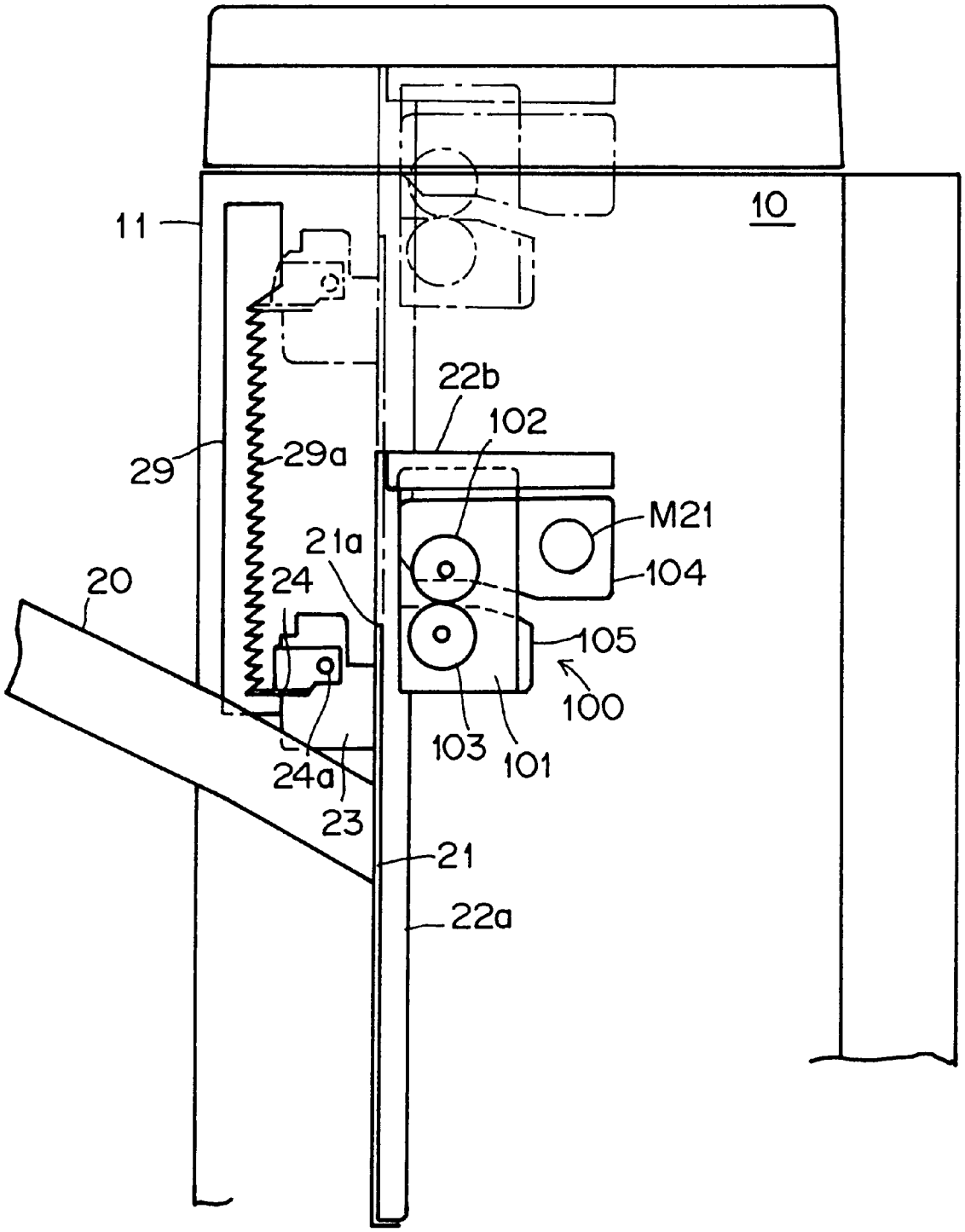
FIG. 5 is an elevational view illustrating the upper part of the staple sorter.

As shown in FIGS. 2 and 5, the sheet conveyer gate 100 is a box 101 provided with a pair of rollers 102 and 103 and with sheet guide plates 104 and 105. The rollers 102 and 103 can be driven and rotated in forward/reverse directions by a motor M21. The sheet conveyer gate 100 can be elevated and lowered, guided by a guide member not shown, and a motor M20 is provided as the drive source. The home position of the sheet conveyer gate 100 is shown in solid line in FIG. 2. In the home position, the gate 100 conveys a sheet which has been delivered from the pair of receiving rollers 81 with the guide of the upper surface of the diverter 82, to the left in FIG. 2 with the rotation of the rollers 102 and 103 to deliver the sheet onto the non-sort tray 20.

Figure 6C:
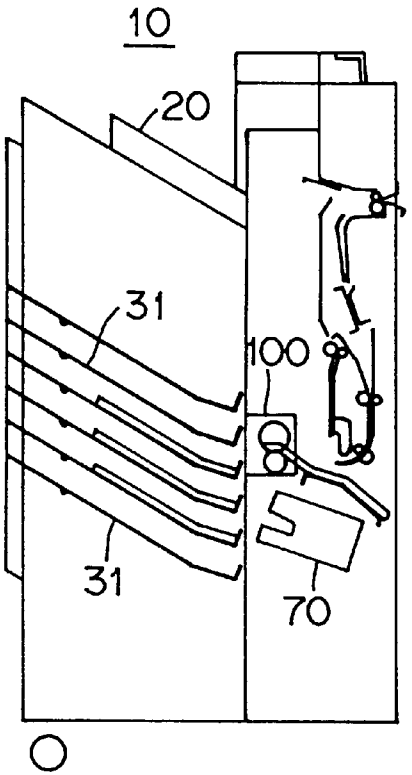
FIGS. 6*a*–6*f* illustrate the operations of the stapling and of the take-out/stacking of stacks of sheets in the staple sorter.
Figure 6B:
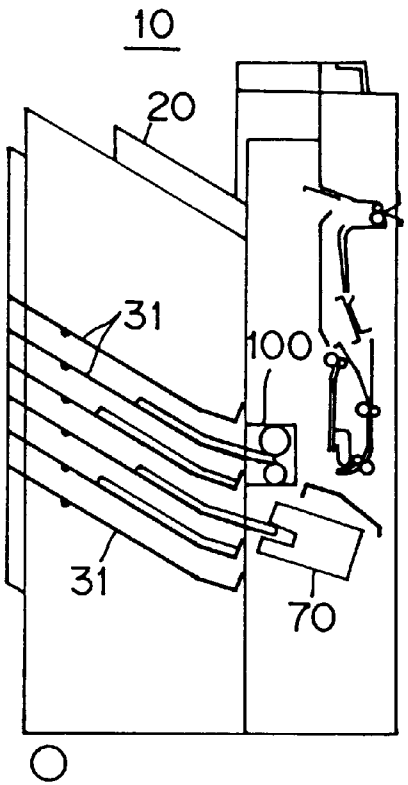
Figure 6A:
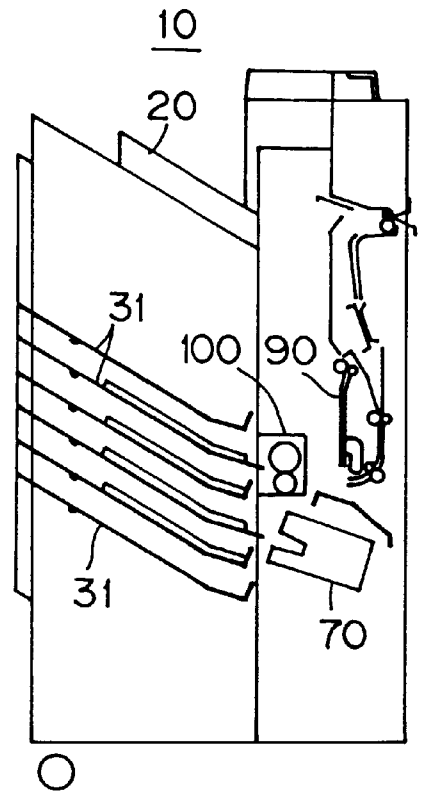
Figure 6F:
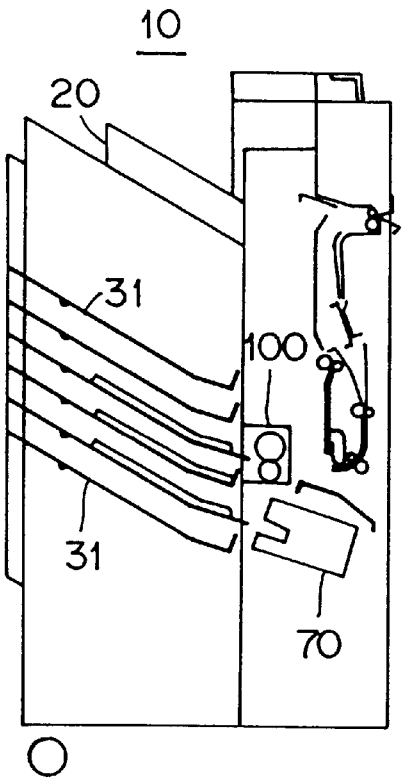
Figure 6E:
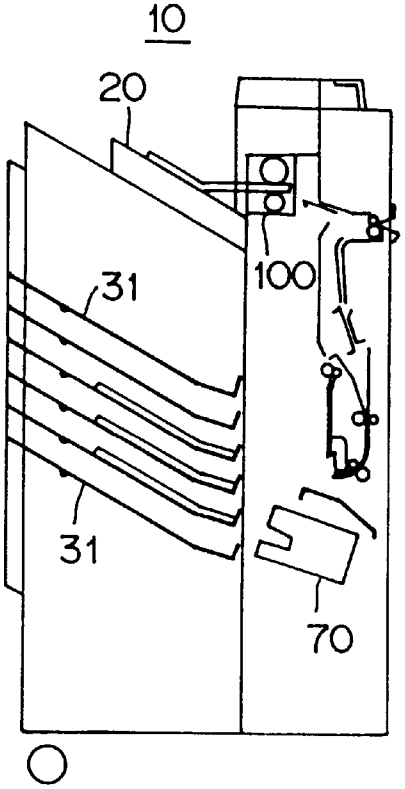
Figure 6D:
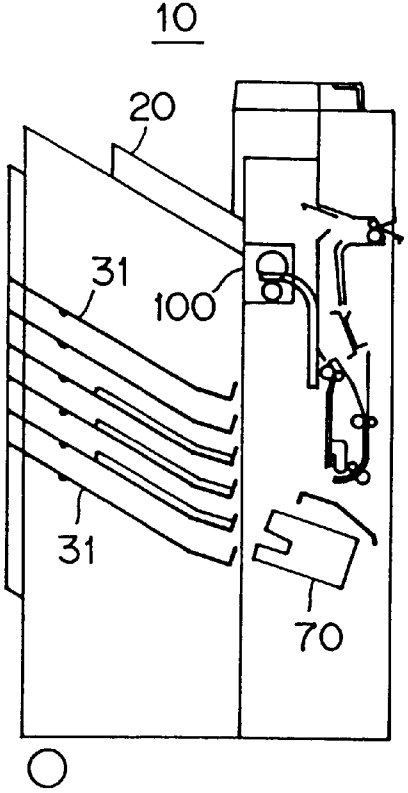

Alternatively, the sheet conveyer gate 100 can be lowered to the position corresponding to the bin 31 set at the level $X_3$ in order to receive a stapled stack of sheets (see FIG. 6*a*). In the receiving position, the gate 100 pinches with the rollers 102 and 103 the stack of sheets which has been pinched and pulled out of the bin 31 by the second chucking unit 40*a* (see FIG. 6*b*). The second chucking unit 40*a* then releases the stack of sheets from the pinching and, simultaneously, the rollers 102 and 103 are driven and rotated in forward direction to take the stack of sheets out of the bin 31 (see FIG. 6*c*). When the stack of sheets completely comes out of the bin 31, the forward rotation of the rollers 102 and 103 is stopped, and the gate 100 is simultaneously elevated (see FIG. 6*d*). When the gate 100 is elevated to a predetermined height, the rollers 102 and 103 are rotated in reverse direction to eject the stack of sheets onto the non-sort tray 20 (see FIG. 6*e*). Subsequently, the gate 100 is lowered to the receiving position (see FIG. 6*f*) to restart the stacking operation.

In the above operation for stacking stapled stacks, as a matter of course, the bin assembly 30 is elevated by one pitch each time the operation is restarted. The operation for stacking stapled stacks is executed in parallel with the handling of stapling a stack of sheets on the bin 31 set at the level $X_1$.

The sheet conveyer gate 100 ejects a stapled stack of sheets onto the non-sort tray 20 normally at its home position shown in solid line in FIG. 5; however, the non-sort tray 20 is capable of storing a large amount of sheets, and in order to ensure the consistency of the sheets, the gate 100 is capable of moving up to and resting at an arbitrary height which is above the home position and as high as or below the upper limit position shown in chain line in FIG. 5. The position where the gate 100 is to move up and to rest corresponds to such a position that a predetermined distance is kept between the sheet-ejecting height of the rollers 102 and 103 and the uppermost surface of the sheets stacked on the non-sort tray 20. That is, the gate 100 is elevated to such a height that the next stack of sheets will be ejected and fall by the predetermined distance to the uppermost surface of the sheets.

In order to realize the above operation, as shown in FIG. 2, above the non-sort tray 20 are provided a sensor SE33 for detecting the presence or absence of sheet on the non-sort tray 20 and a sensor SE23 for detecting the uppermost surface of the sheets on the non-sort tray 20 (or the upside surface of the tray 20 when there is no sheet). In addition, there are provided a sensor SE20 for detecting the home position of the gate 100 and a sensor SE22 for detecting the presence or absence of a stack of sheets in the gate 100.

As shown in FIG. 5, a cover 21 is provided at a position facing the lower end of the non-sort tray 20. The cover 21, which is to regulate the trailing edges (with regard to the ejecting direction) of sheets ejected onto the non-sort tray 20, is arranged so that the cover 21 is elevated in synchronization with the sheet conveyer gate 100 but held at the elevated position when the gate 100 is lowered. That is, the cover 21 has a vertical frame part 22*a* and a horizontal frame part 22*b*, both of which are integrally guided by a guide member (not shown) so that the cover 21 can be moved vertically. A main body frame 11 of the staple sorter 10 has a fixed a frame 29 on which ratchets 29*a* are formed attached thereto. A pawl member 24 mounted to the cover 21 via a bracket 23 is in engagement with the ratchets 29*a*. The pawl member 24 is capable of pivoting counterclockwise about a pin 24*a* but restrained from pivoting clockwise.

When the sheet conveyer gate 100 is set at the home position, the cover 21 is set at its lower limit position shown in solid line in FIG. 5, and the pawl member 24 is in engagement with the lowest ratchet 29*a*. When a large amount of sheets are stacked on the non-sort tray 20, the gate 100 is elevated higher than the home position, and the horizontal frame part 22*b* is then pushed up by the box 101 to elevate the cover 21. At this time, the pawl member 24 pivots counterclockwise about the pin 24*a* and steps over the ratchets 29*a* one by one. The halt of the elevation of the gate 100 allows the pawl member 24 to engage with the facing ratchet 29*a*, so that the cover 21 retains the state of halting at that position when the gate 100 is lowered subsequently. With the above operation, a predetermined distance is kept between the nipping portion of the rollers 102 and 103 and the upper edge 21*a* of the cover 21 when a stack of sheets is ejected.

The upper limit position of the cover 21 is shown in chain line in FIG. 5. When the operator takes sheets away from the non-sort tray 20, the pawl member 24 is released from the restraint on clockwise pivoting (e.g. a restraining member not shown retreats from its restraining position, driven by a solenoid), so that the cover 21 lowers to its lower limit position.

In the following, the staple unit 70 will be described.

The staple unit 70 has a well-known motorized structure and comprises a head 71 where a cartridge containing staples can be attached and detached and an anvil 72 for receiving and folding down a staple struck out from the head 71. The staple unit 70 staples an end portion of a stack of sheets, either in one spot at the corner or in two spots at the center, which has been pulled by the first chucking unit 40 out of the bin 31 set at the level $X_1$. Accordingly, the staple unit 70 can be moved from its home position at the front side of the staple sorter 10 toward the rear side. The staple unit 70 moving toward the rear side stops at predetermined positions to staple a stack of sheets and then returns to the home position.

Figure 7:
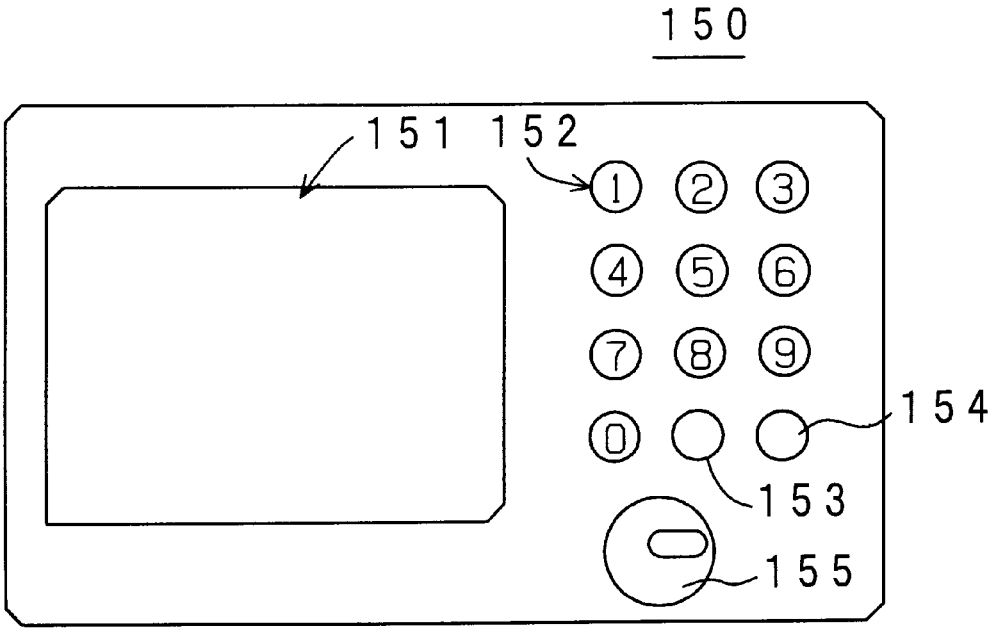
FIG. 7 is a plan view illustrating an operation panel of the copying machine.

FIG. 7 illustrates main parts of the operation panel 150 provided on the copying machine 1. On the operation panel 150 are provided a touch panel 151 by the method of liquid crystal display, a ten-key 152 for setting the number of copies (registered number), a reset key 153, an interrupt service key 154, a copy start key 155 and the like.

Figure 8:
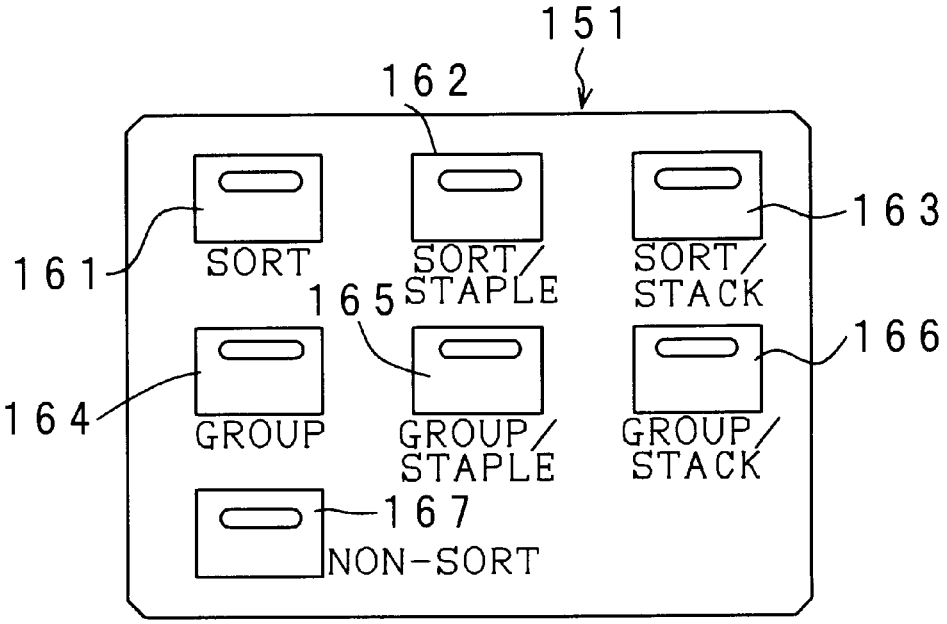
FIG. 8 is a plan view illustrating a screen displayed on the touch panel of the operation panel.

FIG. 8 illustrates a screen displayed on the touch panel 151. There are displayed a sort mode selector key 161, a sort/staple mode selector key 162, a sort/stack mode selector key 163, a group mode selector key 164, a group/staple mode selector key 165, a group/stack mode selector key 166 and a non-sort mode selector key 167.

Figure 10:
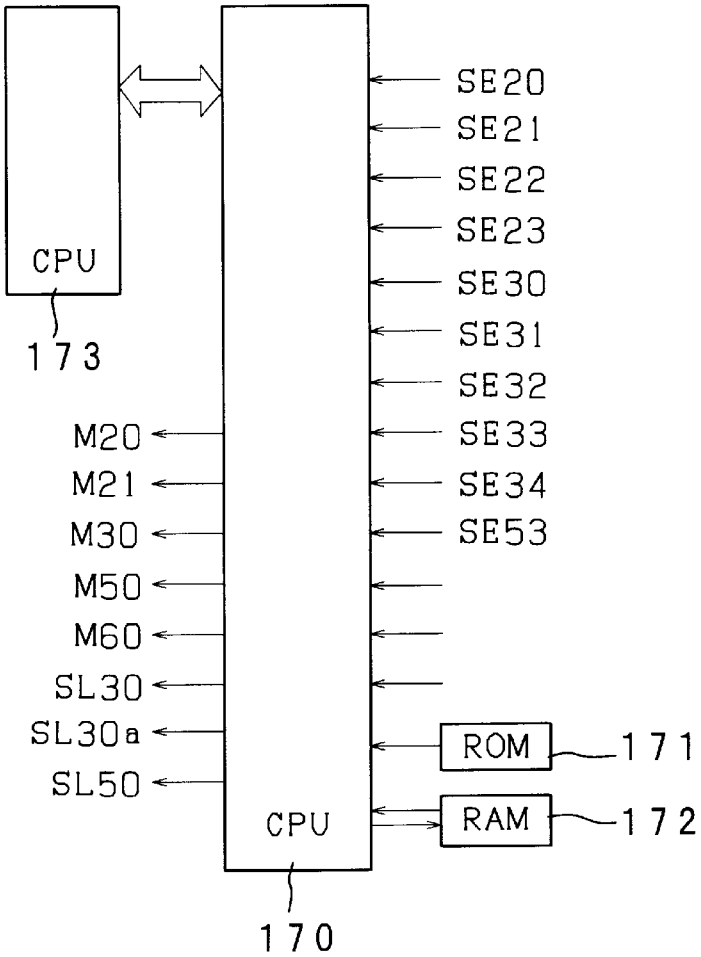
FIG. 10 is a block diagram illustrating the control circuit of the copying machine.

FIG. 10 illustrates the control circuit of the copying machine 1 and of the staple sorter 10. The control circuit mainly comprises a CPU 170 provided with a ROM 171 and with a RAM 172. The CPU 170 controls the motors M20, M21, M30, M50 and M60, the solenoids SL30, SL30*a* and SL5O, a motor for moving the staple unit 70, a motor for driving the staple unit 70, and the like, in accordance with a program stored in the ROM 171. The detection signals from the sensors and the like are inputted into the CPU 170. The CPU 170 also communicates with other CPUs, e.g. a CPU 173 which controls the automatic document feeder 5, to exchange necessary data with the CPUs.

In the following, controlling procedures by the CPU 170 will be described referring to the flowcharts shown in FIGS. 11 to 21.

First of all, various flags and counters used in the flowcharts will be described.

A sort flag F1 indicates that the sort mode has been established.

A group flag F2 indicates that the group mode has been established.

A staple flag F3 indicates that the staple mode has been established.

A stack flag F4 indicates that the stack mode for stacking stapled stacks of sheets on the non-sort tray 20 has been established.

An initial gate operation flag F5 indicates that the gate 100 has been set at its home position.

A chucking flag F6 permits an operation of chucking a stack of sheets.

A chucking unit operation flag F7 permits the chucking units 40 and 40*a* to move from their home positions.

A staple unit operation flag F8 permits the staple unit 70 to perform stapling.

A take-out operation flag F9 permits the sheet conveyer gate 100 to operate to take out a stack of sheets.

A one-bin take-out completion flag F15 indicates that the operation in which the sheet conveyor gate 100 takes a stack of sheets out of one of the bins 31 and stacks the stack of sheets has been completed.

A registered number counter A stores the number of copies (registered number) set by the operator.

A job counter B counts the number of times of circulation of original documents in the automatic document feeder 5. There are twenty bins. Accordingly, if the registered number is more than 20 in the sort mode, original documents are circulated a plurality of times, and twenty copies of each original document are made in each circulation. For example, if the registered number is "50", twenty copies of each original document are made first and distributed onto the bins $\mathbf{31}_1$–$\mathbf{31}_{20}$ (the first circulation of original documents). This operation is defined as "one job"; the counter B is therefore set at "1". After the completion of one job, the stacks of sheets on the bins 31 are sequentially stapled and stacked on the non-sort tray 20 by the sheet conveyer gate 100. Then additional twenty copies of each original document are made, distributed onto the bins $\mathbf{31}_1$–$\mathbf{31}_{20}$ (the second circulation), stapled, and stacked. In the third circulation, ten copies of each document are made, distributed onto the bins $\mathbf{31}_1$–$\mathbf{31}_{10}$, stapled, and stacked.

A bin counter C indicates the number of bins to be used in one job. For example, in the case that the registered number is "30", "20" is displayed in the first job, and then "10" in the second job.

A take-out bin counter D counts the number of bins from which a stack of sheets has not been taken out, in the stack mode.

A travel summation counter E counts the travel of the vertical movement of the gate 100 in the stack mode.

A travel constant counter F counts the travel (a constant) of the gate 100 from the home position to the position for receiving a stack of sheets.

A total travel counter G counts the travel of the gate 100 from the position for receiving a stack of sheets to the position for ejecting the stack of sheets onto the non-sort tray 20.

A stapled-bin counter H counts the number of bins where stapling has been performed.

A group storing bin counter I counts the number of bins which have been stored with any sheets, in the group mode. The counted value corresponds to the number of original documents.

A travel correction counter P counts a value for correcting the position to which the gate 100 is to be elevated in proportion to the thickness of a stack of sheets. In the sort mode, the value is the number of original documents multiplied by the thickness of a sheet for copying. In the group mode, the registered number multiplied by the thickness of a sheet for copying.

In the following description, "on-edge" means the moment when a switch, a sensor, a signal or the like is switching from an off state to an on state, and "off-edge" means the moment when a switch, a sensor, a signal or the like is switching from an on state to an off state.

Figure 11:
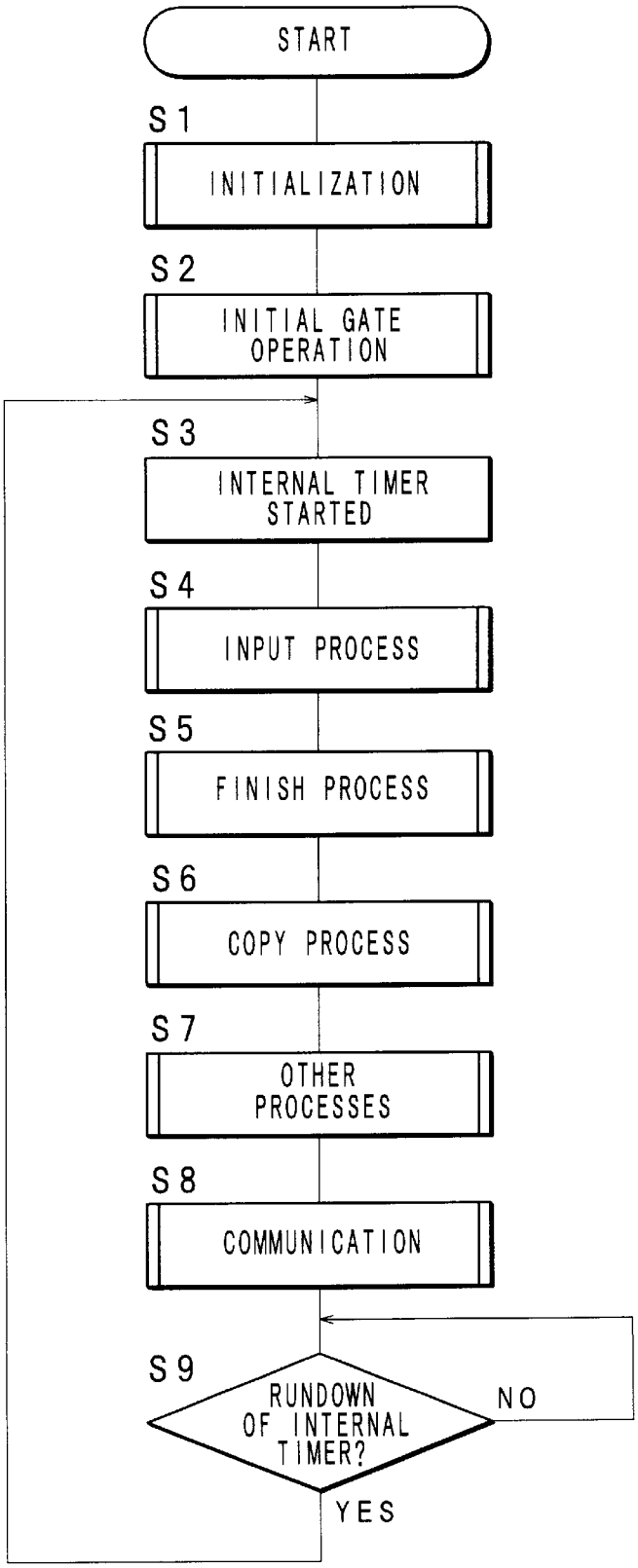
FIG. 11 is a flowchart illustrating the main routine of the CPU of the control circuit.

FIG. 11 illustrates the main routine of the CPU 170.

When the power is turned on and the program starts, the initialization of each control parameter and of each device is executed in the step S1, and then an initial gate operation is executed in the step S2. In the step S3 an internal timer is started. The internal timer determines the time required for one routine, which time has been set previously in the step S1. Subsequently, subroutines of the steps S4, S5, S6, S7 and S8 are sequentially called to perform necessary processes. When the rundown of the internal timer is verified in the step S9, the return to the step S3 is effected.

Figure 12:
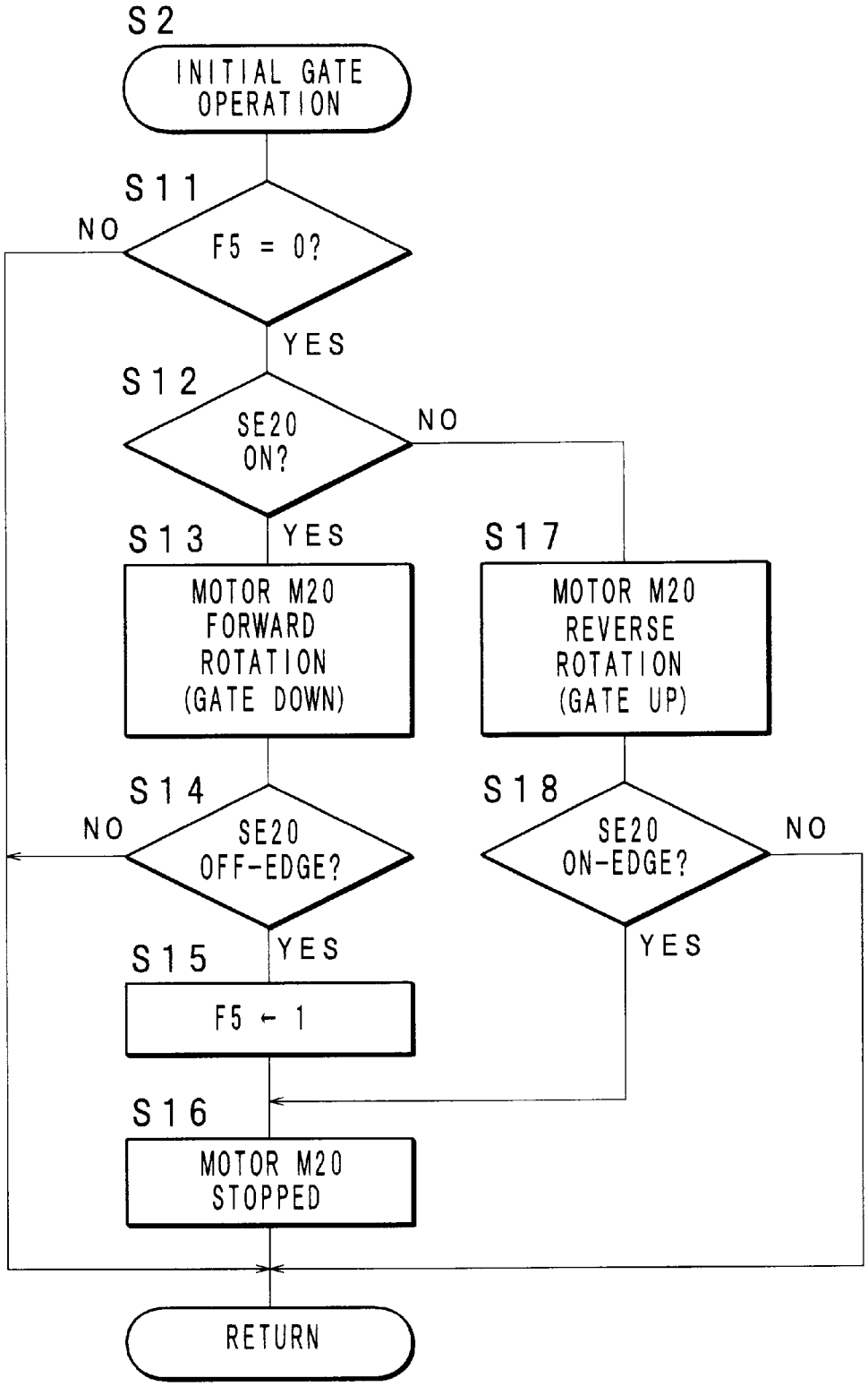
FIG. 12 is a flowchart illustrating a subroutine of initial gate operation.

FIG. 12 illustrates the subroutine of the initial gate operation executed in the step S2 of the main routine. In this subroutine, the sheet conveyer gate 100 is set at its home position.

In the step S11, whether the initial gate travel flag F5 is set at "0" or not is judged. In the case that the flag has been reset to "0", whether the sensor SE20 is ON or not is checked in the step S12. The sensor SE20 is ON when the gate 100 is above its home position and is OFF when the gate 100 is below the home position. When the sensor is ON, the gate moving motor M20 is operated in forward direction in the step 13, thereby starting to lower the gate 100. In the step S14, whether the sensor SE20 is off-edge or not is checked. In the case that the sensor is off-edge, i.e., in the case that the gate 100 has reached the home position, the flag F5 is set at "1" in the step S15, and the motor M20 is stopped in the step S16. When the sensor SE20 is OFF (the result in the step S12 is NO), on the other hand, the motor M20 is operated in reverse direction in the step S17 to start to elevate the gate 100, for the gate 100 is below the home position. In the step S18, whether the sensor SE20 is on-edge or not is checked. In the case that the sensor is on-edge, the motor M20 is stopped in the step S16. After that, the gate 100 is set at the home position through the steps S12 to S16.

Figure 13:
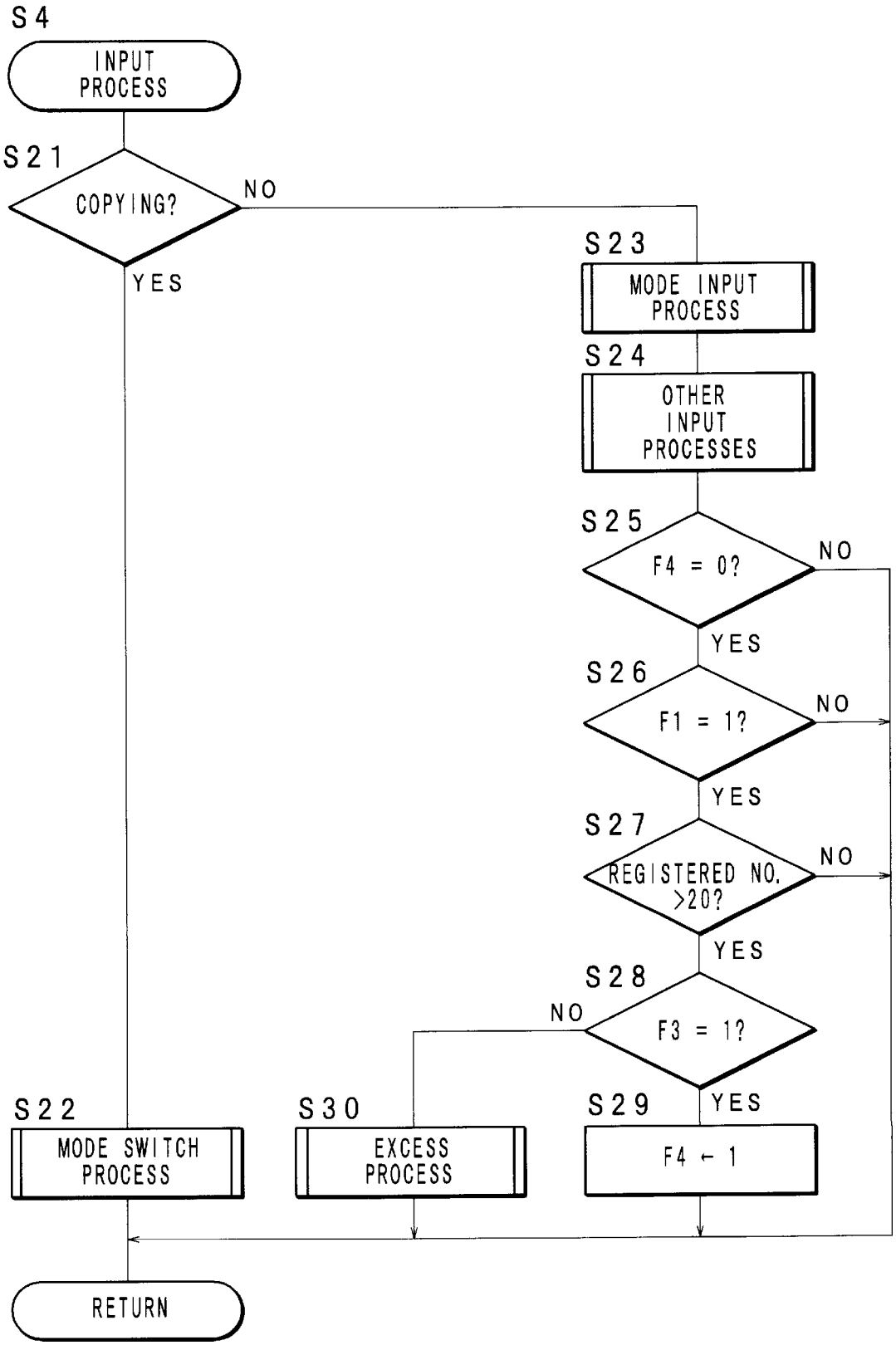
FIG. 13 is a flowchart illustrating a subroutine of input process.

FIG. 13 illustrates the subroutine of input process executed in the step S4 of the main routine. In this subroutine, the information on mode selection inputted by the operator from the operation panel 150 is put into the CPU 170.

In the step S21, whether copies are being made or not is judged. In the case that copies are being made, mode switching process is executed in the step S22. In the case that copies are not being made, mode input process is executed in the step S23 and other input processes, e.g. the input of the registered number set by the operator on the ten-key 152 into the CPU 170, are executed in the step S24. In the step 25, whether the stack flag F4 is set at "0" or not is checked; whether the sort flag F1 is set at "1" or not is checked in the step S26. In the case that both the results in the steps S25 and S26 are "YES," it is verified in the step S27 that the registered number exceeds "20", and whether the staple flag F3 is set at "1" or not is then checked in the step S28. In the case that the staple flag F3 has been set at "1," the stack flag F4 is set at "1" in the step S29. That is, the stack flag F4 is set at "1" so that stapled stacks of sheets are automatically stacked on the non-sort tray 20 after the completion of one job, because the handling in the case that the registered number exceeds "20", which is the number of the bins, cannot be done in one job. In this case, the stack mode is forcefully established so that a series of processes in the sort/staple mode in the case of the registered number not less than "21" are executed, even though the operator has not selected the stack mode. In the case that the staple flag F3 has been reset to "0" (i.e. the result in the step S28 is NO), on the other hand, the process on an excess over the number of bins is executed in the step S30, for stacks of sheets which have not been stapled cannot be automatically taken out of the bins 31 to be delivered onto the non-sort tray 20.

Figure 14:
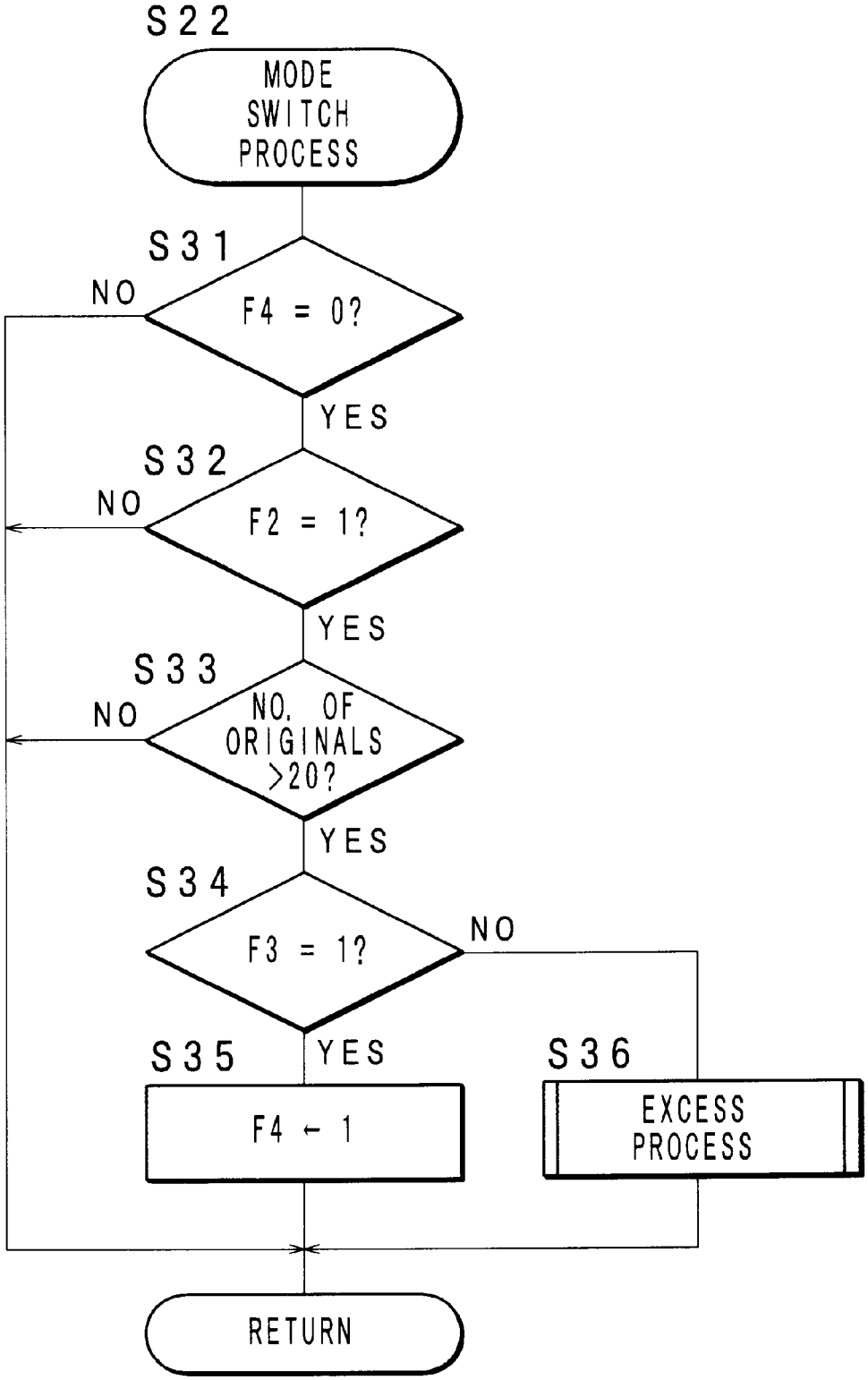
FIG. 14 is a flowchart illustrating a subroutine of mode switching process.

FIG. 14 illustrates the subroutine of mode switch process which is executed in the step S22.

In the subroutine, it is verified in the step S31 that the stack flag F4 is "0", and it is verified in the step S32 that the group flag F2 is "1". Whether the number of original documents is larger than "20" or not is then judged in the step S33. The number of original documents is counted each time the automatic document feeder 5 feeds an original document onto the platen glass. Specifically, while the copies of the nineteenth original document are being made, the presence or absence of an original document on the document tray of the automatic document feeder 5 is detected. In the case that there is an original document at this time, the original document is the twenty-first one and the result of the step S33 is YES. In this case, the copies of the twenty-first document cannot be distributed onto any bin 31 because the number of the bins is twenty. Accordingly, whether the staple flag F3 is "1" or not is judged in the step S34; in the case that the staple flag F3 has been set at "1," the stack flag F4 is set at "1" in the step S35. That is, in the case that the stapling process is executed, stapled stacks of sheets are delivered onto and stacked on the non-sort tray 20 with the sheet conveyer gate 100, so that the copying process (group/staple mode) proceeds with regard to the twenty-first and later documents.

In the case that the staple flag F3 has been reset to "0" (i.e. the result of the step S34 is NO), on the other hand, the process on an excess over the number of bins is executed in the step S36 because the stacks of sheets which have not been stapled cannot be automatically taken out of the bins 31 to be delivered onto the non-sort tray 20.

Figure 15:
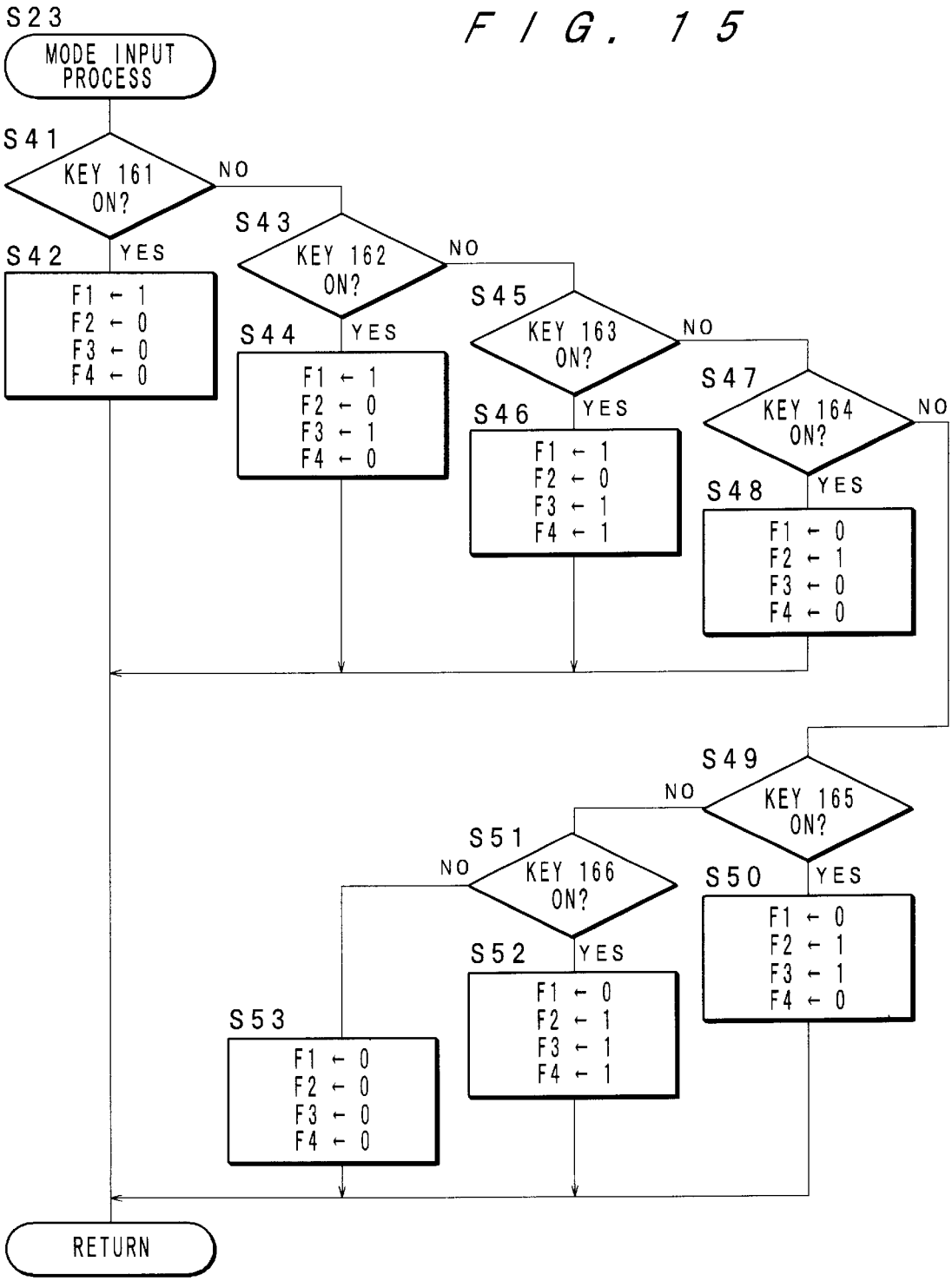
FIG. 15 is a flowchart illustrating a subroutine of mode input process.

FIG. 15 illustrates the subroutine of mode input process which is executed in the step S23.

In the subroutine, the ON or OFF states of the mode selector keys 161-166 on the touch panel 151 are checked in the steps S41, S43, S45, S47, S49 and S51, respectively. According to the ON-state keys of the keys 161–166, the flags F1–F4 are set/reset to "1" or "0" in the corresponding step S42, S44, S46, S48, S50, S52 or S53.

Figure 16:
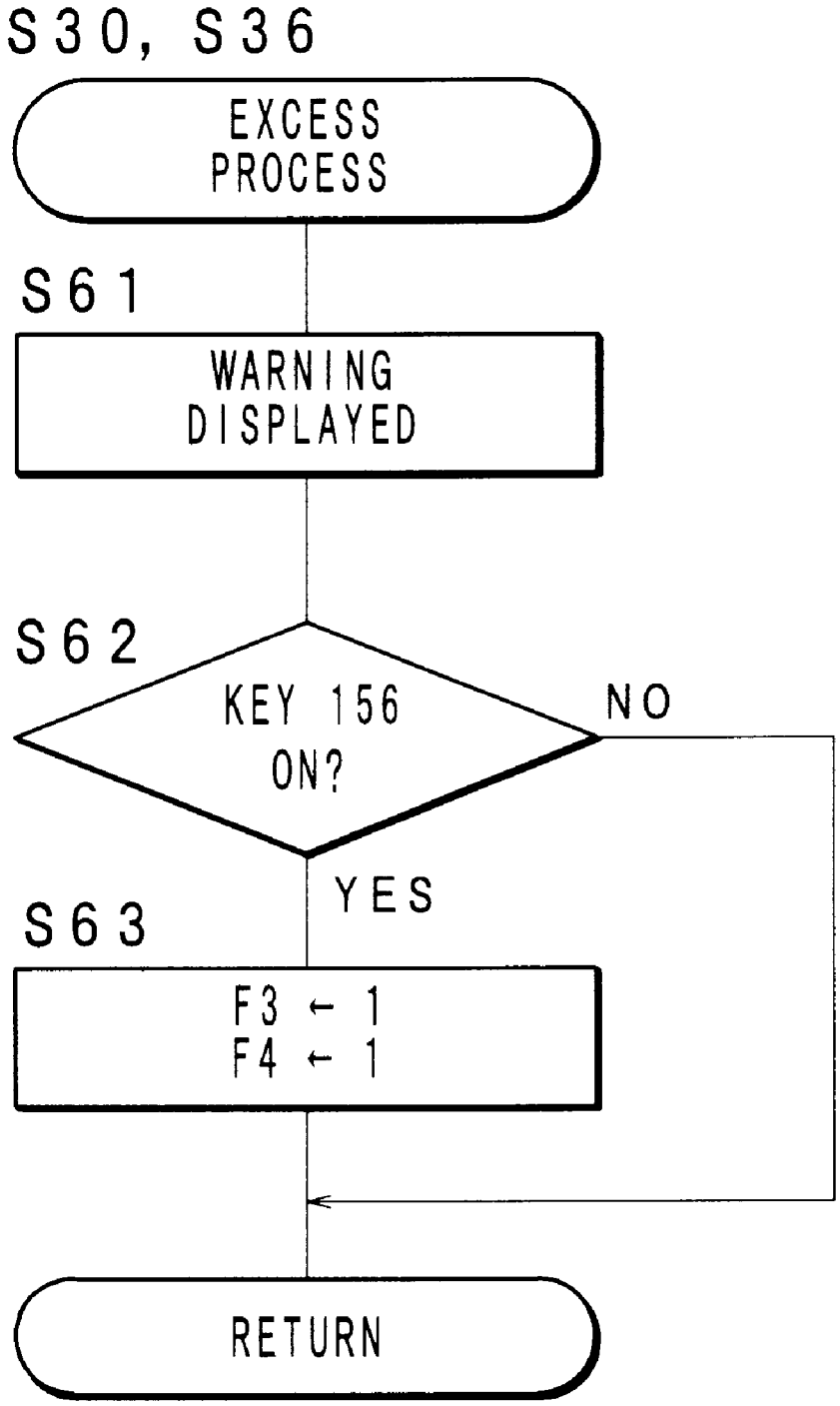
FIG. 16 is a flowchart illustrating a subroutine of the process on an excess over the number of bins.

FIG. 16 illustrates the subroutine of the process on an excess over the number of bins which is executed in the steps S30 and S36.

The subroutine is executed when the registered number exceeds "20" in the sort/non-staple mode (see the step S30) or when the number of original documents exceeds "20" in the group/non-staple mode (see the step S36).

Figure 9:
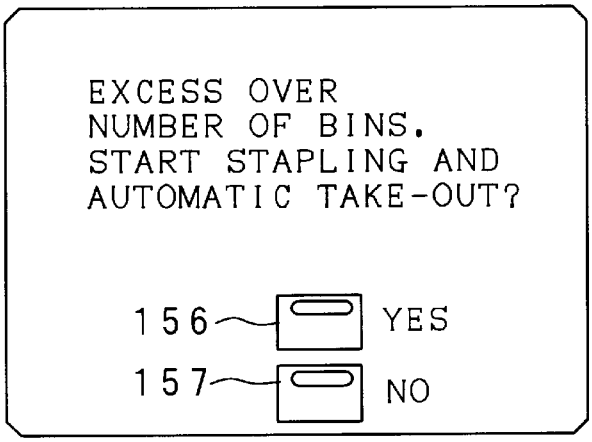
FIG. 9 is a plan view illustrating another screen displayed on the touch panel.

In the first place, a warning display is presented on the touch panel 151 in the step S61. As shown in FIG. 9, the warning display comprises the text "There would be an excess over the number of bins. Start stapling process and automatic take-out?," a YES key 156, and a NO key 157. The operator then turns on either the key 156 or the key 157.

When it is verified in the step S62 that the YES key 156 has been turned on, the staple flag F3 and the stack flag F4 are set at "1" in the step S63.

Figure 17:
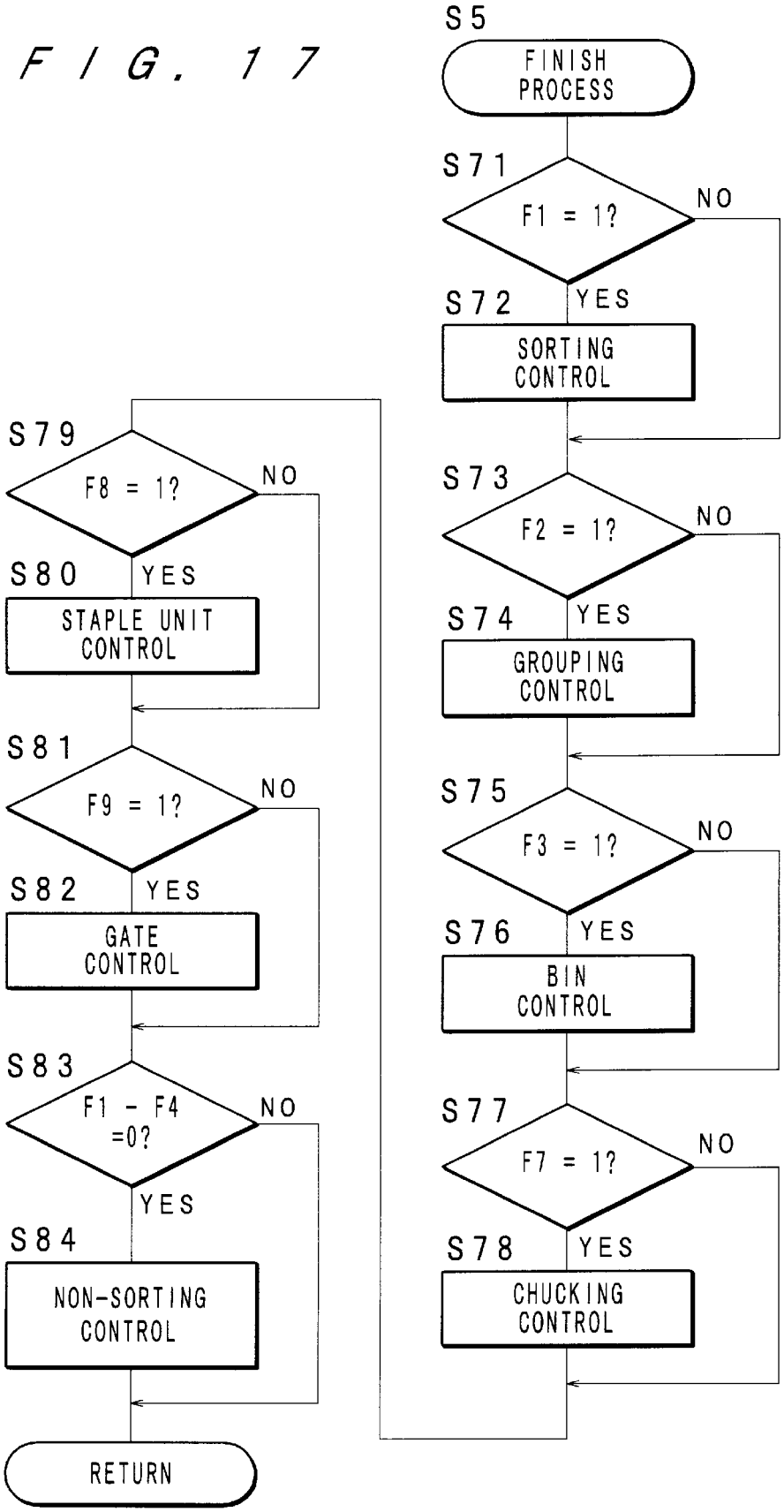
FIG. 17 is a flowchart illustrating a subroutine of finish process.
Figure 18A:
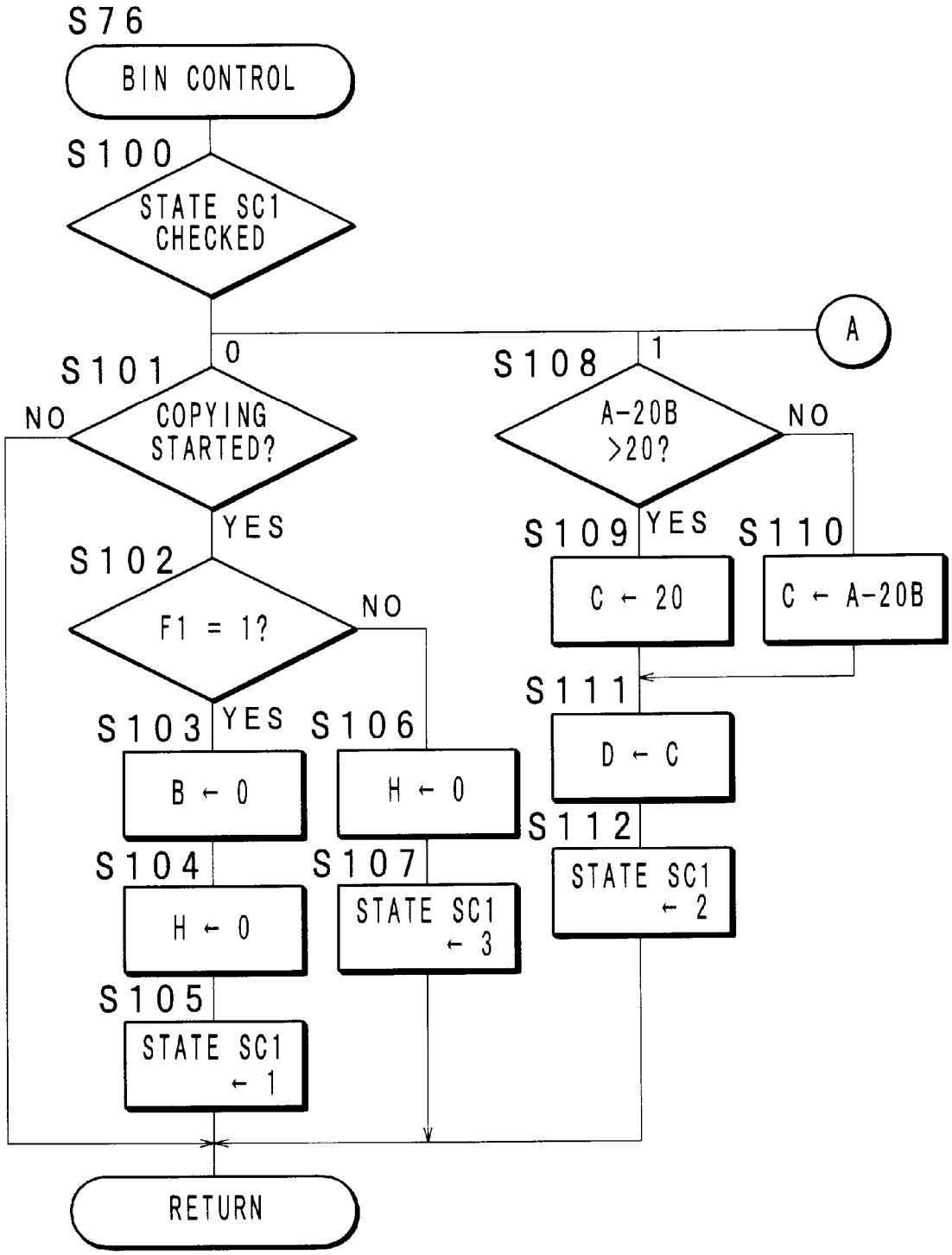
FIGS. 18*a*–18*i* are flowcharts illustrating a subroutine of bin control.
Figure 18B:
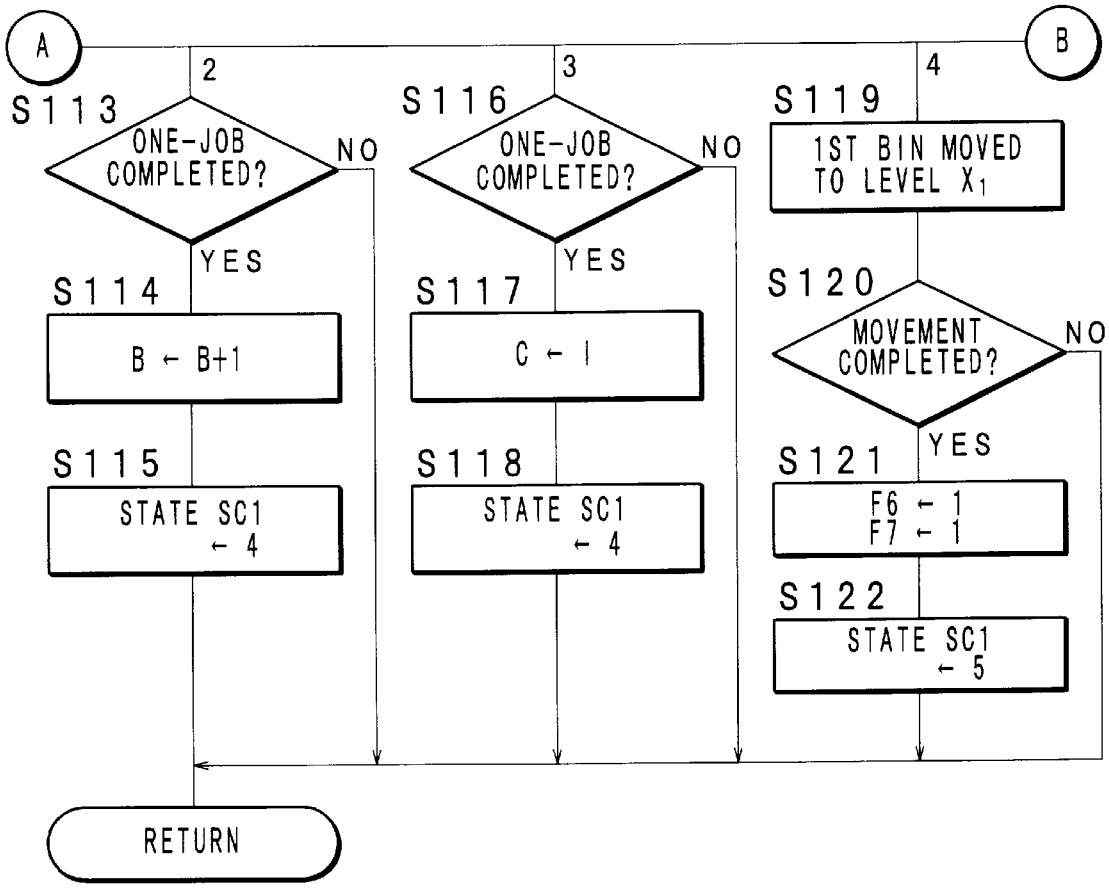
Figure 18C:
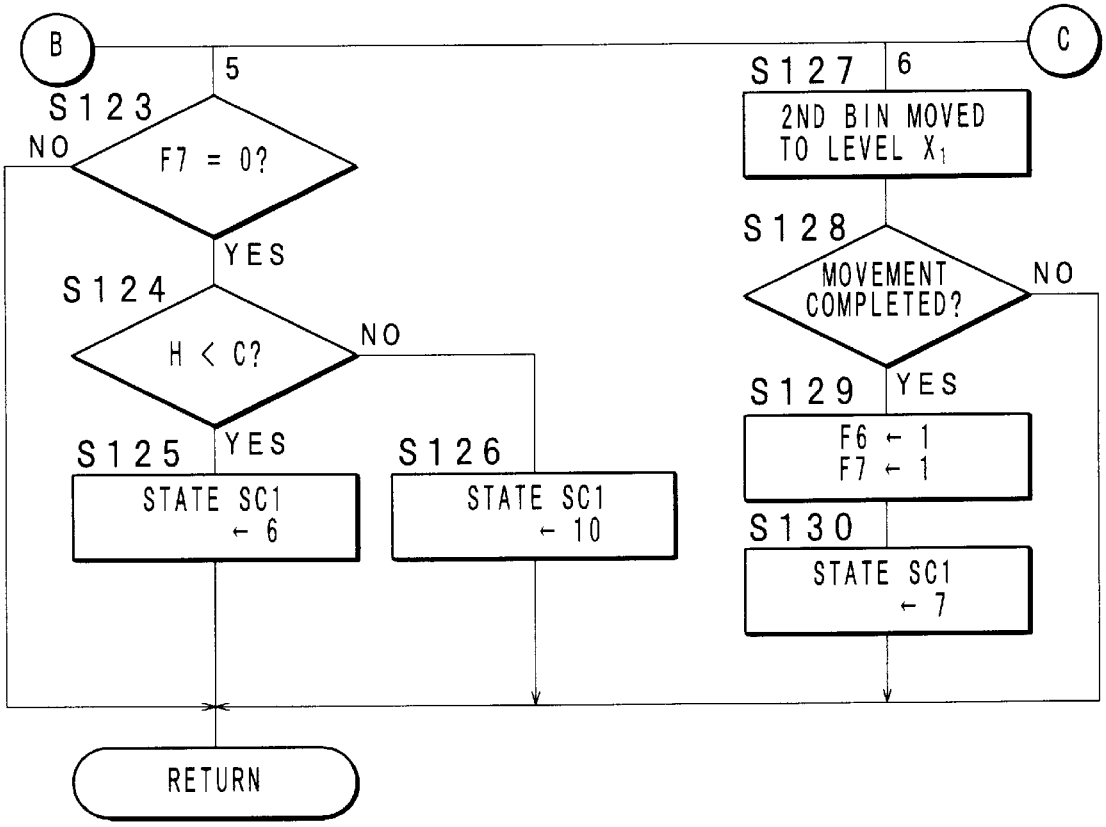
Figure 18D:
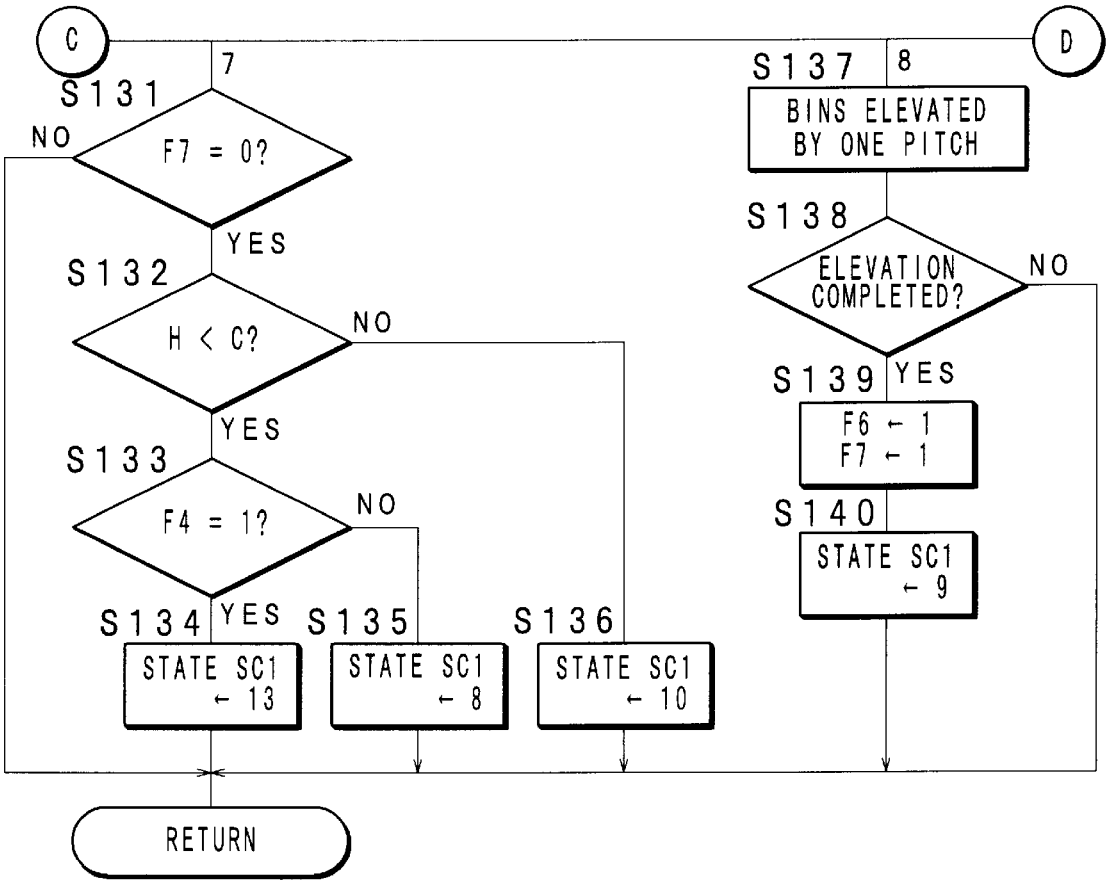
Figure 18E:
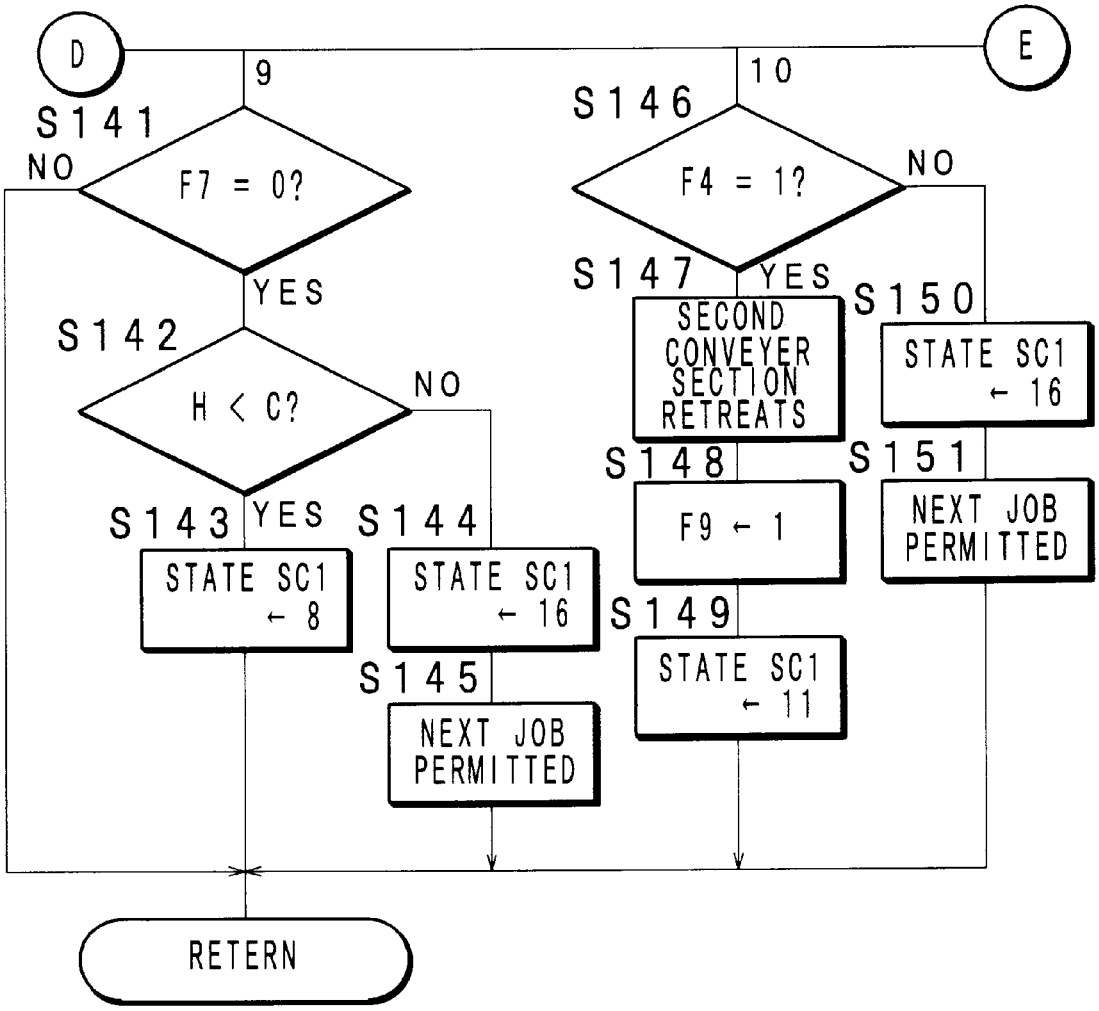
Figure 18F:
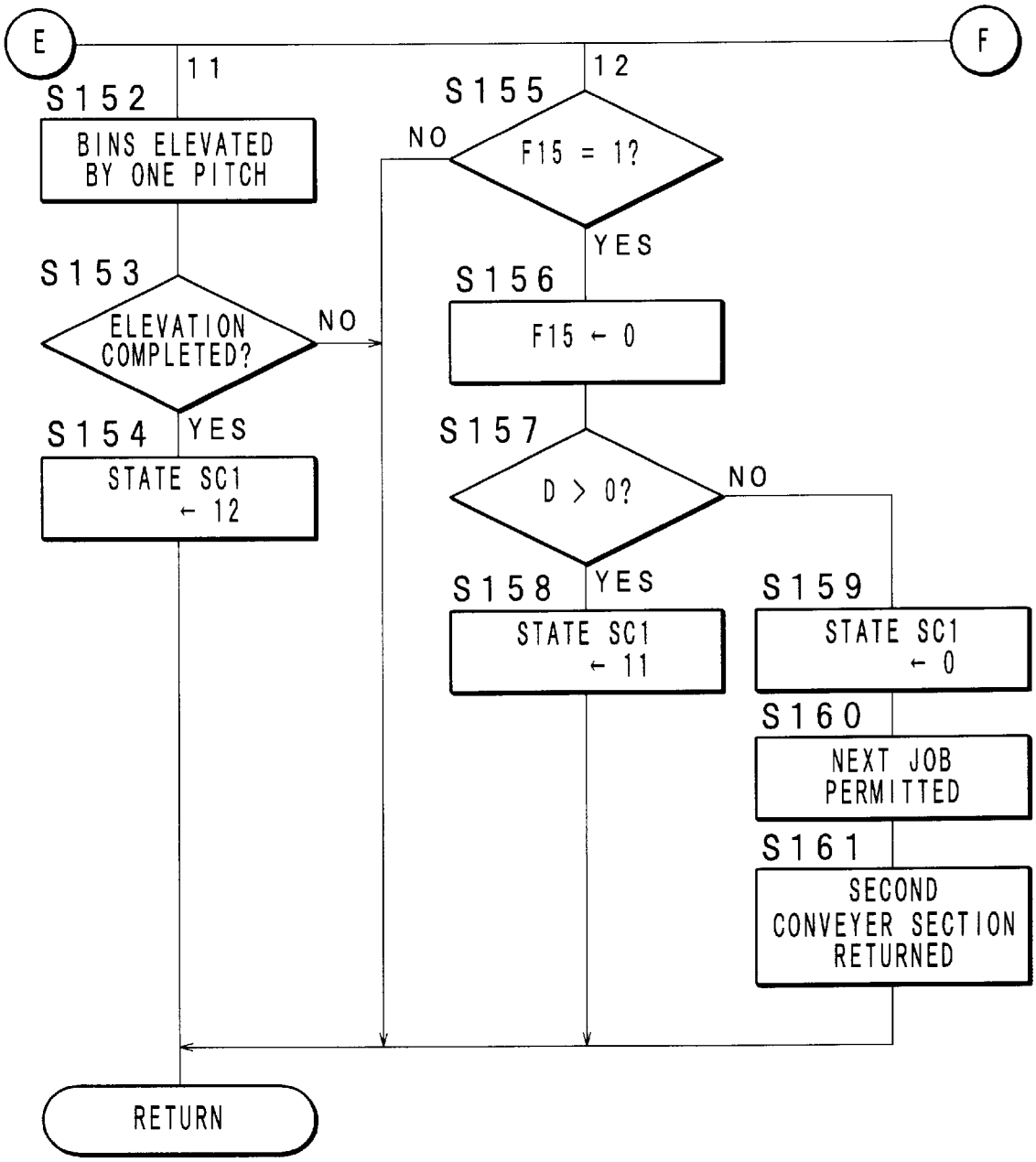
Figure 18G:
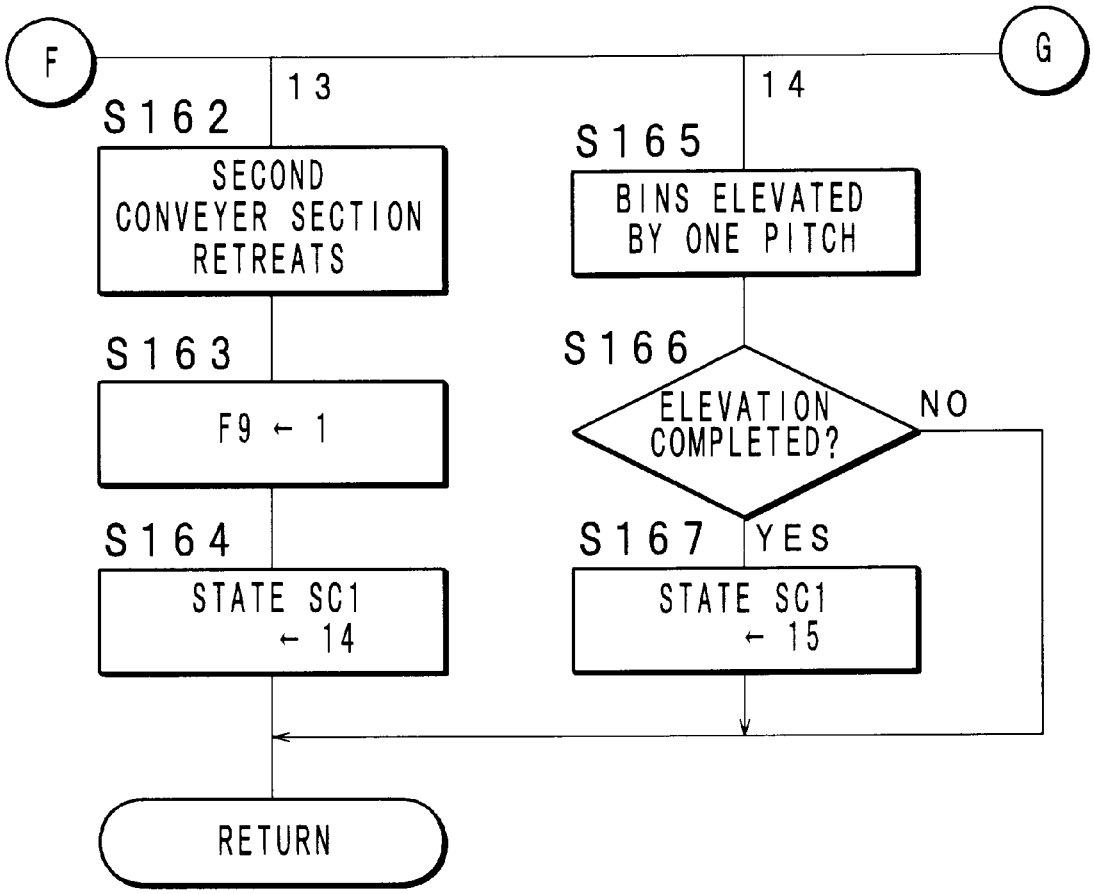
Figure 18H:
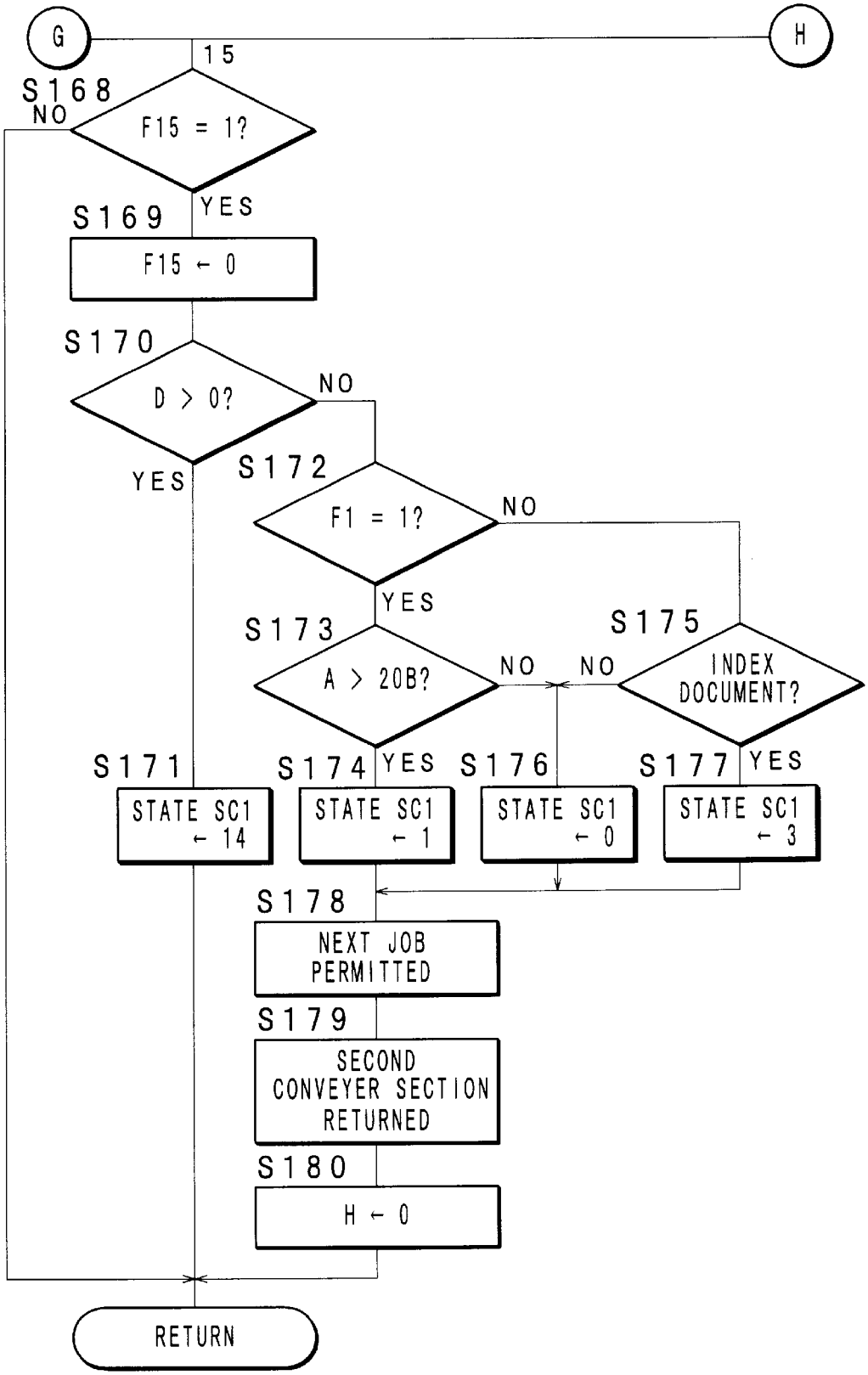
Figure 18I:
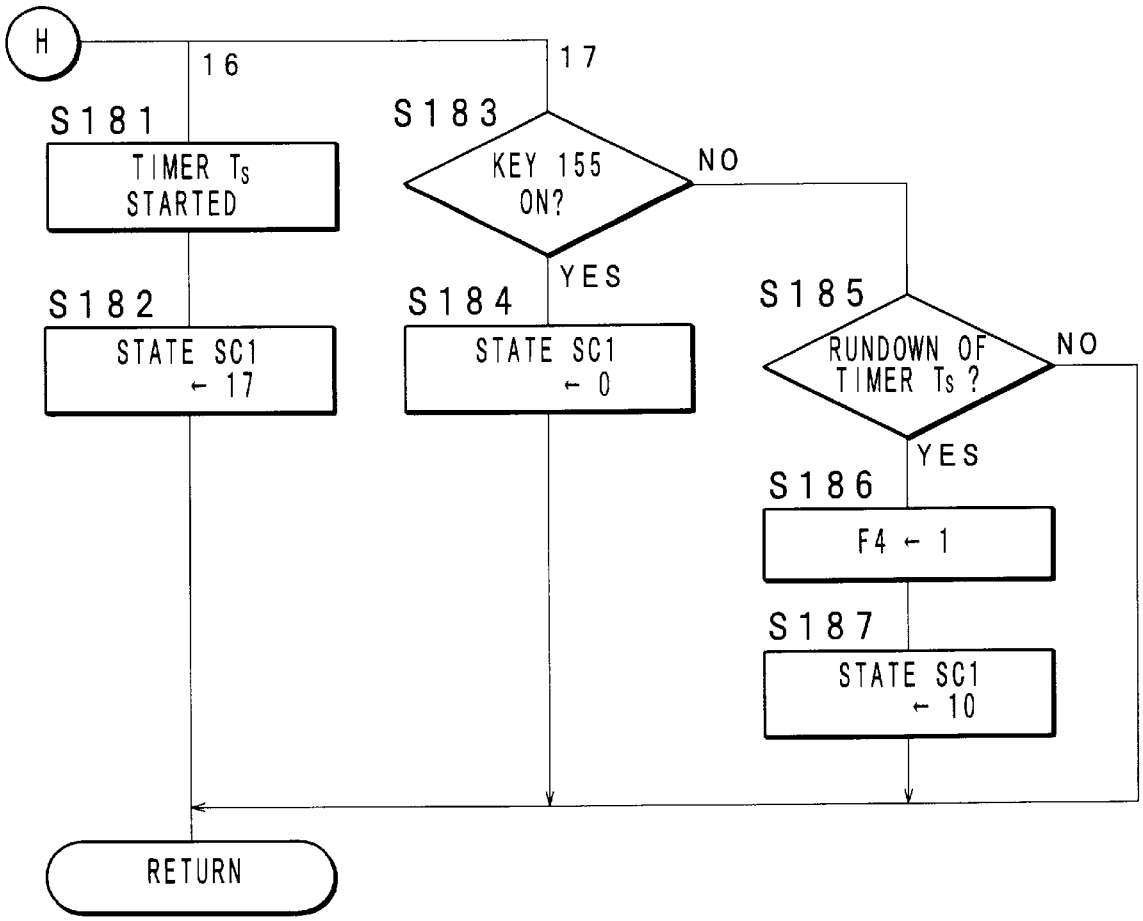

FIG. 17 illustrates the subroutine of finish process which is executed in the steps S5 of the main routine. The subroutine executes the process specified by each flag which has been set at "1."

That is, if the sort flag F1 is "1" (i.e., if the result of the step S71 is YES), the control for sorting is effected (step S72); if the group flag F2 is "1" (i.e., if the result of the step S73 is YES), the control for grouping is effected (step S74); if the staple flag F3 is "1" (i.e., if the result of the step S75 is YES), the control of elevating the bins by one pitch at a time for the stapling process is effected (step S76); if the chucking unit operation flag F7 is "1" (i.e., if the result of the step S77 is YES), the control for chucking is effected (step S78); if the staple unit operation flag F8 is "1" (i.e., if the result of the step S79 is YES), the control for the staple unit is effected (step S80); if the take-out operation flag F9 is "1" (i.e., if the result of the step S81 is YES), the control of moving the sheet conveyer gate 100 vertically to stack stacks of sheets is effected (step S82); if all of the flags F1–F4 are set at "0" (i.e., if the result of the step S83 is YES), the control of delivering sheets directly onto the non-sort tray 20 is effected (step S84).

The description of the control for sorting and the control for grouping which are effected in the steps S72 and S74 is omitted because both the controls are the well-known one of delivering copies onto each bin 31 sequentially. Besides, the description of the control for the staple unit which is effected in the step S80 is also omitted because the control is of hammering staples into a stack of sheets with the staple unit 70 and is the well-known one for staple sorters similar to the staple sorter 10.

FIGS. 18*a*–18*i* illustrate the subroutine of bin control which is executed in the step S76. In the subroutine, the counted value of a state SC1 is checked in the step S100, and the following processes are then executed according to the counted value.

When the state SC1 is 0 and the start of copying operation is verified in the step S101, whether the sort flag F1 is "1" or not is then checked in the step S102. In the case that the sort flag F1 has been set at "1", the job counter B is reset to 0 in the step S103, and the stapled-bin counter H is reset to 0 in the step S104. Then the state SC1 is set at 1 in the step S105. In the case that the sort flag F1 has been reset to "0" (i.e. the result of the step S102 is NO), on the other hand, the counter H is reset to 0 in the step S106, and the state SCl is set at 3 in the step S107.

When the state SC1 is 1, the truth or falsity of the expression "A-20B>20" is checked in the step S108. That is, whether the number of copies to be made in the subsequent copy operation is larger than 20 or not is judged. When the result of the step S108 is YES, the bin counter C is set at 20 in the step S109. When the result is NO, the bin counter C is set at "A-20B" in the step S110. In the steps S109 and S110, the number of the bins which will be used in the one job to be executed subsequently is inputted into the counter C; in the step Sill, the take-out bin counter D for the bins to be emptied is then set at the value of the counter C; in the step S112, the state SC1 is set at 2.

When the state SC1 is 2 and it is verified in the step S113 that the operations in one job have been completed, the job counter B is set at "B+1" in the step S114, and then the state SC1 is set at 4 in the step S115.

When the state SC1 is 3 and it is verified in the step S116 that the operations in one job have been completed, the bin counter C is set at the value of the group storing bin counter I in the step S117. The state SC1 is then set at 4 in the step S118.

When the state SC1 is 4, the first bin 31 is moved to the level $X_1$ in the step S119, that is, the bin assembly 30 is returned to its home position. In the subroutine, the stapling process is performed sequentially on the bins 31, starting from the first bin $\mathbf{31}_1$, and the stapled stack of sheets is taken out when each bin 31 is elevated to the level $X_3$. If it is verified in the step S120 that the first bin $\mathbf{31}_1$ has been moved to the level $X_1$, the chucking flag F6 and the chucking unit operation flag F7 are set at "1" in the step S121. After that, the state SC1 is set at 5 in the step S122. By setting the flags F6 and F7 at "1" in the step S121, the pinching/take-out of stacks of sheets is performed by the chucking units 40 and 40*a* in the chucking control (see FIGS. 19*a*, 19*b*) which will be described later.

When the state SC1 is 5 and it is verified in the step S123 that the chucking unit operation flag F7 has been reset to "0", the comparison between the counted value of the stapled-bin counter H and the counted value of the bin counter C is performed in the step S124. If "H<C" is true, then the state SC1 is set at 6 in the step S125; if "H<C" is false, then the state SC1 is set at 10 in the step S126.

When the state SC1 is 6, the second bin $\mathbf{31}_2$ is moved to the level $X_1$ in the step S127. When the completion of the movement is verified in the step S128, the chucking flag F6 and the chucking unit operation flag F7 are set at "1" in the step S129. After that, the state SC1 is set at 7 in the step S130.

When the state SC1 is 7 and it is verified in the step S131 that the chucking unit operation flag F7 has been reset to "0", the comparison between the counted value of the stapled-bin counter H and the counted value of the bin counter C is performed in the step S132. If "H<C" is true, then whether the stack flag F4 is "1" or not is checked in the step S133. If the stack flag F4 has been set at "1," the state SC1 is set at 13 in the step S134; that is, the process for taking out stacks of sheets by the sheet conveyer gate 100 is prepared. If the stack flag F4 is "0," the state SC1 is set at 8 in the step S135. In this case, the process for taking out stacks of sheets is not executed. If "H<C" is false (i.e. the result of the step S132 is NO), on the other hand, the state SC1 is set at 10 in the step S136.

When the state SC1 is 8, the bins 31 are elevated by one pitch in the step S137. When the completion of the elevation by one pitch is verified in the step S138 (this means the verification of the fact that one of the bins 31 has been set at the stapling position of the level $X_1$), the chucking flag F6 and the chucking unit operation flag F7 are set at "1" in the step S139. After that, the state SC1 is set at 9 in the step S140.

When the state SC1 is 9 and it is verified in the step S141 that the chucking unit operation flag F7 has been reset to "0", the comparison between the counted value of the stapled-bin counter H and the counted value of the bin counter C is performed in the step S142. If "H<C" is true, the state SC1 is set at 8 in the step S143, and the bins 31 are elevated by additional one pitch; if "H<C" is false, the state SC1 is set at 16 in the step S144, and the permission to execute the next job is granted in the step S145.

When the state SC1 is 10, whether the stack flag F4 is "1" or not is checked in the step S146. If the stack flag F4 has been set at "1", the second conveyer section 90 is retreats from the sheet conveying position, in the step S147, so that the sheet conveyer gate 100 can be lowered. Then the take-out operation flag F9 is set at "1" in the step S148, and the state SC1 is set at 11 in the step S149. If the stack flag F4 has been reset to "0" (i.e. the result of the step S146 is NO), on the other hand, the state SC1 is set at 16 in the step S150, and the permission to execute the next job is granted in the step S151.

When the state SC1 is 11, the bins 31 are elevated by one pitch in the step S152. When the completion of the elevation by one pitch is verified in the step S153 (this means the verification of the fact that one of the bins 31 has been set at the take-out position of the level $X_3$), the state SC1 is set at 12 in the step S154.

When the state SC1 is 12 and it is verified in the step S155 that the one-bin take-out completion flag F15 has been set at "1," the flag F15 is reset to "0" in the step S156. In the step S157, whether the counted value of the take-out bin counter D for the bins to be emptied is larger than zero or not is checked. In the case of "D>0", the state SC1 is set at 11 in the step S158, and the next bin 31 is thus elevated to the level $X_3$. In the case of "D>0", i.e., in the case that all the stacks of sheets on the bins 31 where any sheets had been distributed have been taken out, the state SC1 is reset to 0 in the step S159, and the permission to execute the next job is granted in the step S160. After that, the second conveyer section 90 is returned to its sheet conveying position in the step S161.

When the state SC1 is 13, the second conveyor section 90 is retreats from the sheet conveying position in the step S162, and the take-out operation flag F9 is set at "1" in the step S163. The state SC1 is then set at 14 in the step S164.

When the state SC1 is 14, the bins 31 are elevated by one pitch in the step S165. If the completion of the elevation by one pitch is verified in the step S166, i.e., if the next bin 31 has been elevated to the take-out position of the level $X_3$, the state SC1 is set at 15 in the step S167.

When the state SC1 is 15 and it is verified in the step S168 that the one-bin take-out completion flag F15 has been set at "1", the flag F15 is reset to "0" in the step S169. In the step S170, whether the counted value of the take-out bin counter D is larger than zero or not is checked. In the case of "D>0", the state SC1 is set at 14 in the step S171, and the next bin 31 is thus elevated to the level $X_3$. In the case of "D=0", i.e., in the case that all the stacks of sheets on the bins 31 where any sheets had been distributed have been taken out, whether the sort flag F1 is 1 or not is checked in the step S172. If the sort flag F1 has been set at 1, the truth or falsity of the expression "A>20B" is checked in the step S173. If the expression "A>20B" is true, i.e., if the number of the copies which have been made is less than the registered number, the state SC1 is set at 1 in the step S174. If the expression "A>20B" is false, i.e., if the number of the copies which have been made has reached the registered number which has been established, the state SC1 is reset to 0 in the step S176.

If the sort flag F1 is "0" (i.e. the result of the step S172 is NO), on the other hand, the presence or absence of "index document" is judged in the step S175. Herein, the "index document" means the twenty-first document which has been fed to the position immediately before the platen glass in the automatic document feeder 5. In the presence of the index document, the state SC1 is set at 3 in the step S177; in the absence of the index document, the state SC1 is reset to 0 in the step S176.

Then the permission to execute the next job is granted in the step S178, and the second conveyer section 90 is returned to its sheet conveying position in the step S179. In the step S180, the stapled-bin counter H is reset to 0.

When the state SC1 is 16, a timer Ts is started in the step S181, and the state SC1 is set at 17 in the step S182. The timer Ts is for starting the process in which, when stapled stacks of sheets are left on any of the bins 31, the stacks are automatically conveyed onto and stacked on the non-sort tray 20 after the expiration of a predetermined period of time.

When the state SC1 is 17, whether the copy start key 155 has been turned on or not is checked in the step S183. If the key 155 has been turned on, i.e., if the next operation for making copies has been started, the state SC1 is reset to 0 in the step S184. If the key 155 has not been turned on, i.e., if the next operation for making copies has not been started, whether the timer Ts has run down or not is checked in the step S185. After the rundown of the timer Ts, the stack flag F4 is set at "1" in the step S186, and the state SC1 is set at 10 in the step S187. The settings cause the stapled stacks of sheets left on the bins 31 to be conveyed onto and stacked on the non-sort tray 20.

Figure 19A:
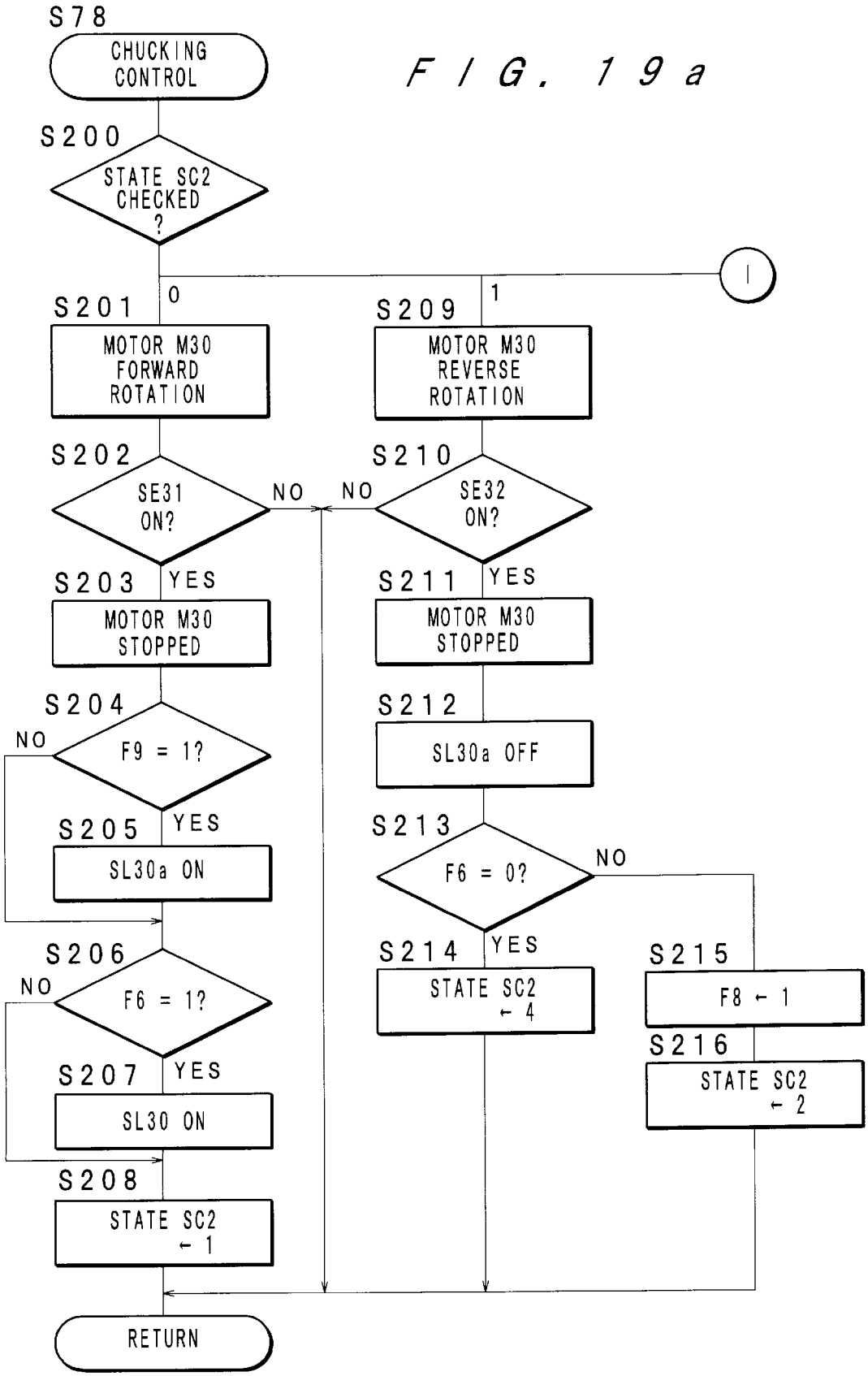
FIGS. 19*a* and 19*b* are flowcharts illustrating a subroutine of chucking control.
Figure 19B:
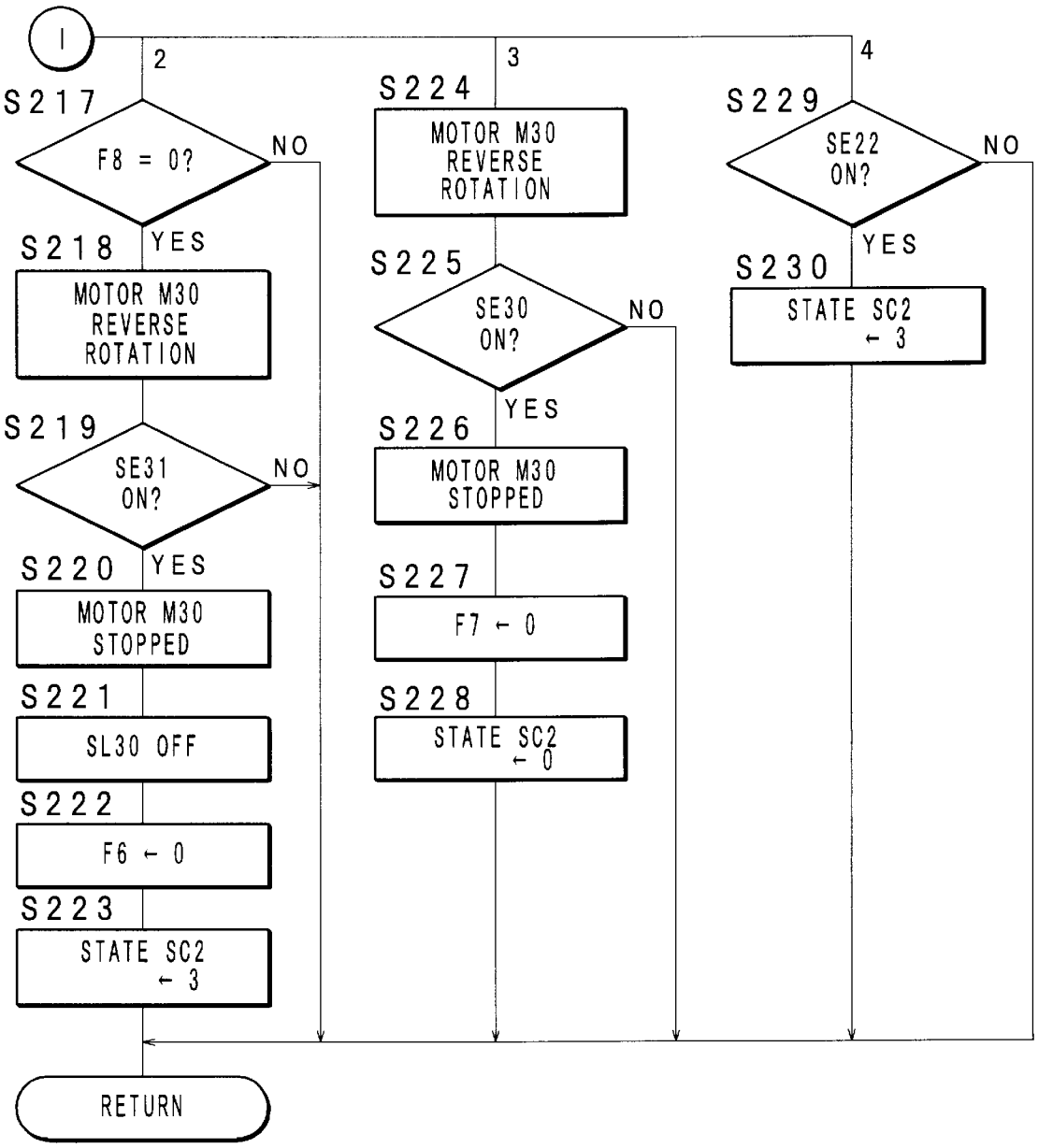
Figure 20A:
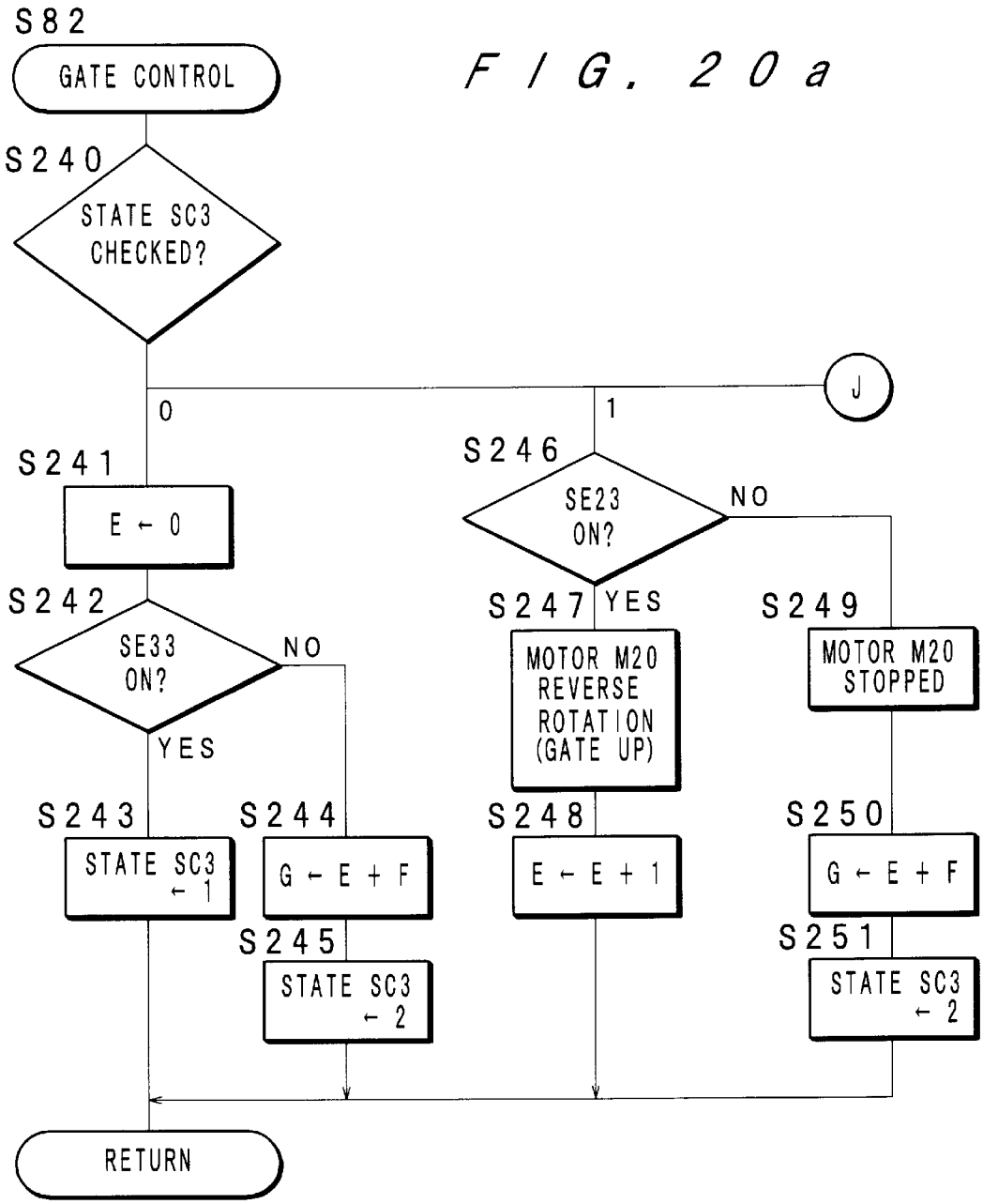
FIGS. 20*a*–20*e* are flowcharts illustrating a subroutine of gate control.
Figure 20B:
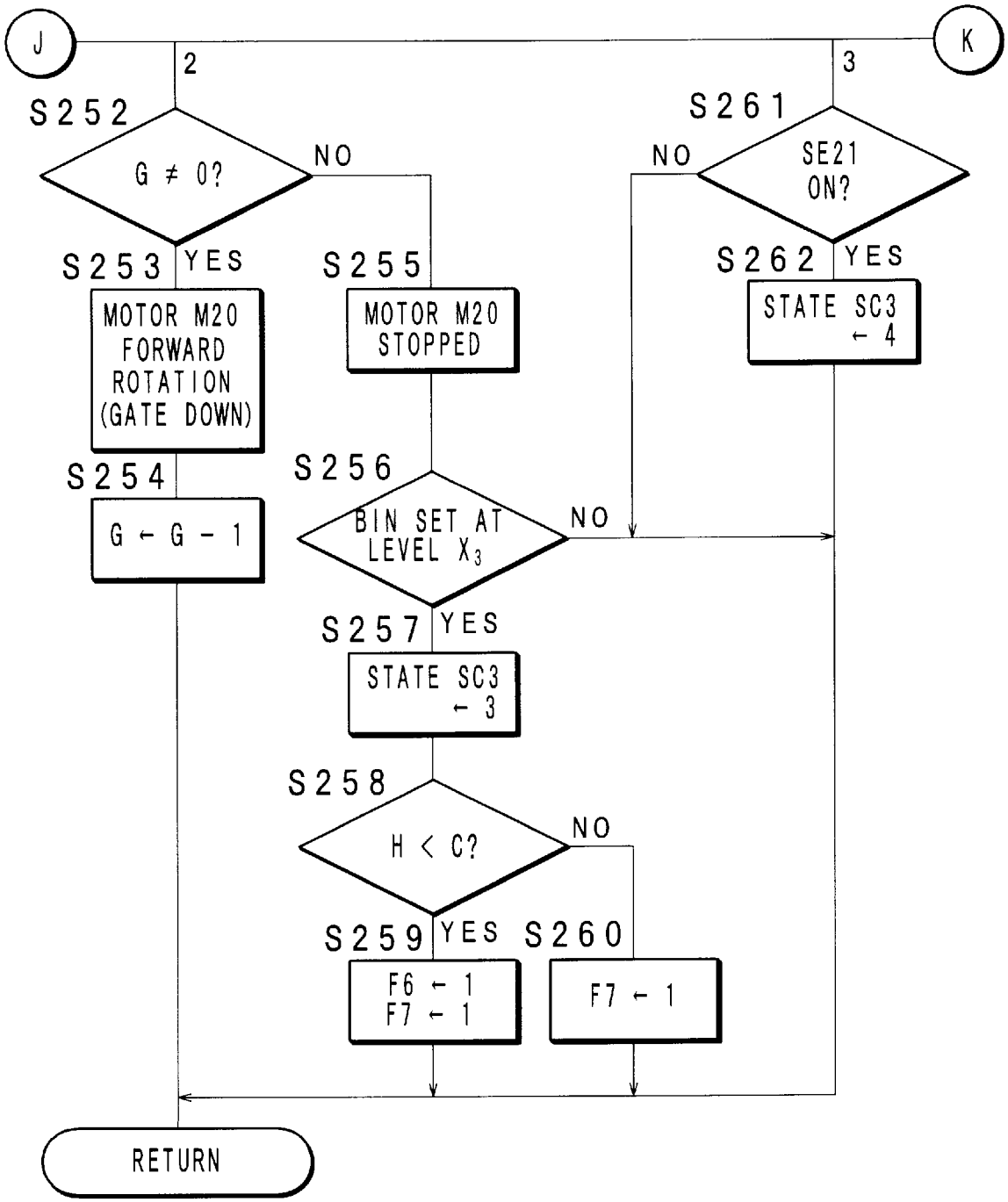
Figure 20C:
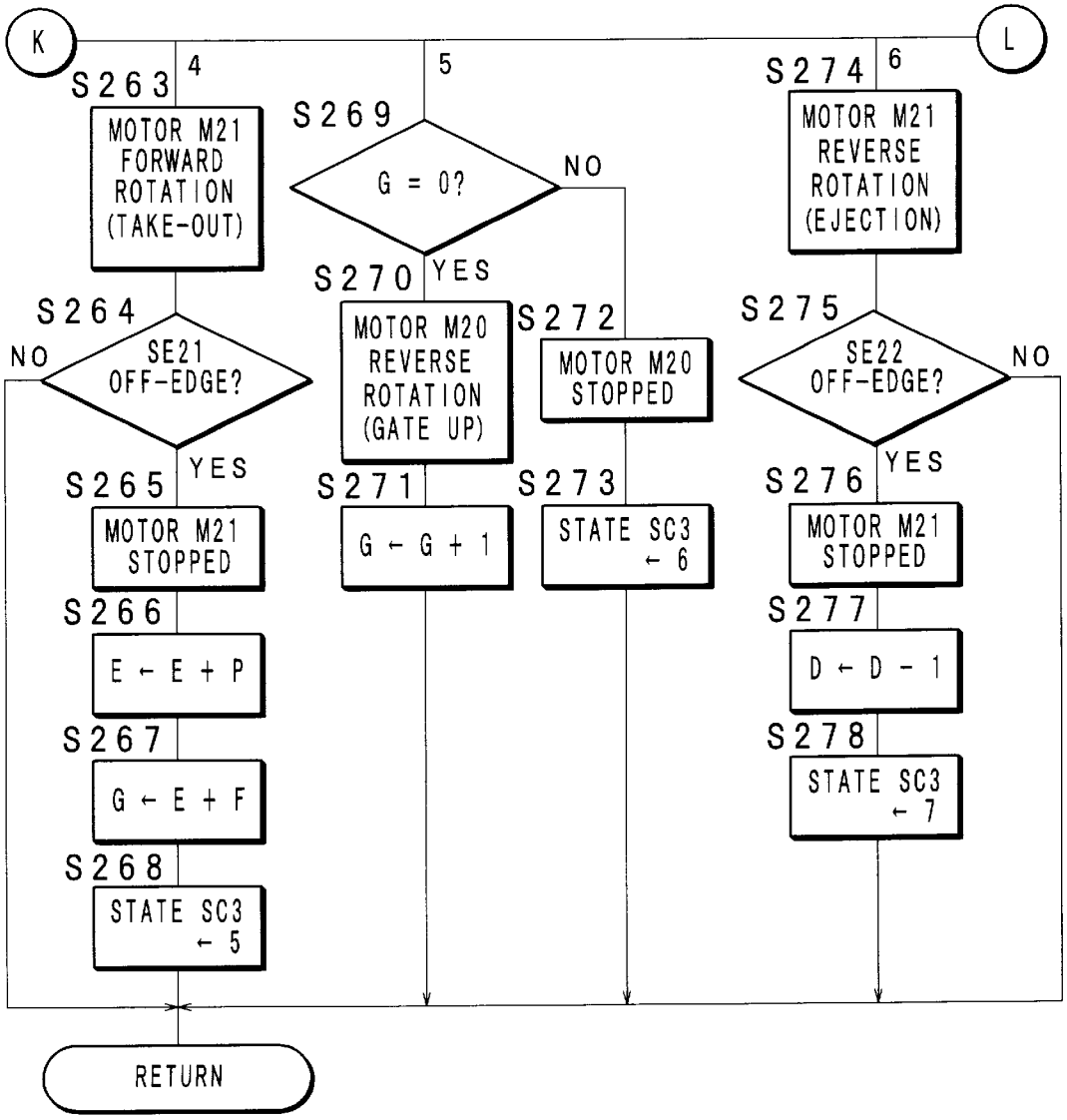
Figure 20D:
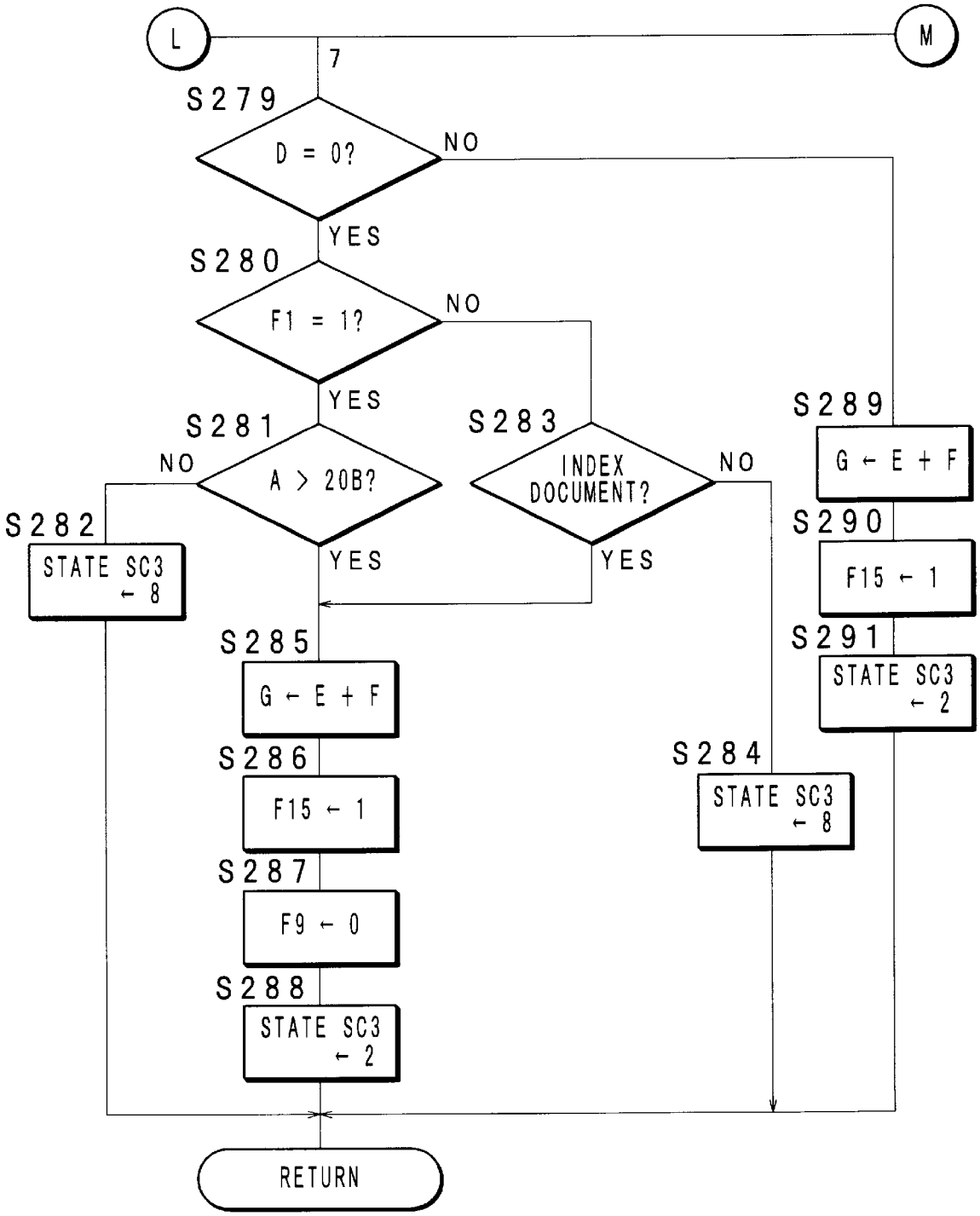
Figure 20E:
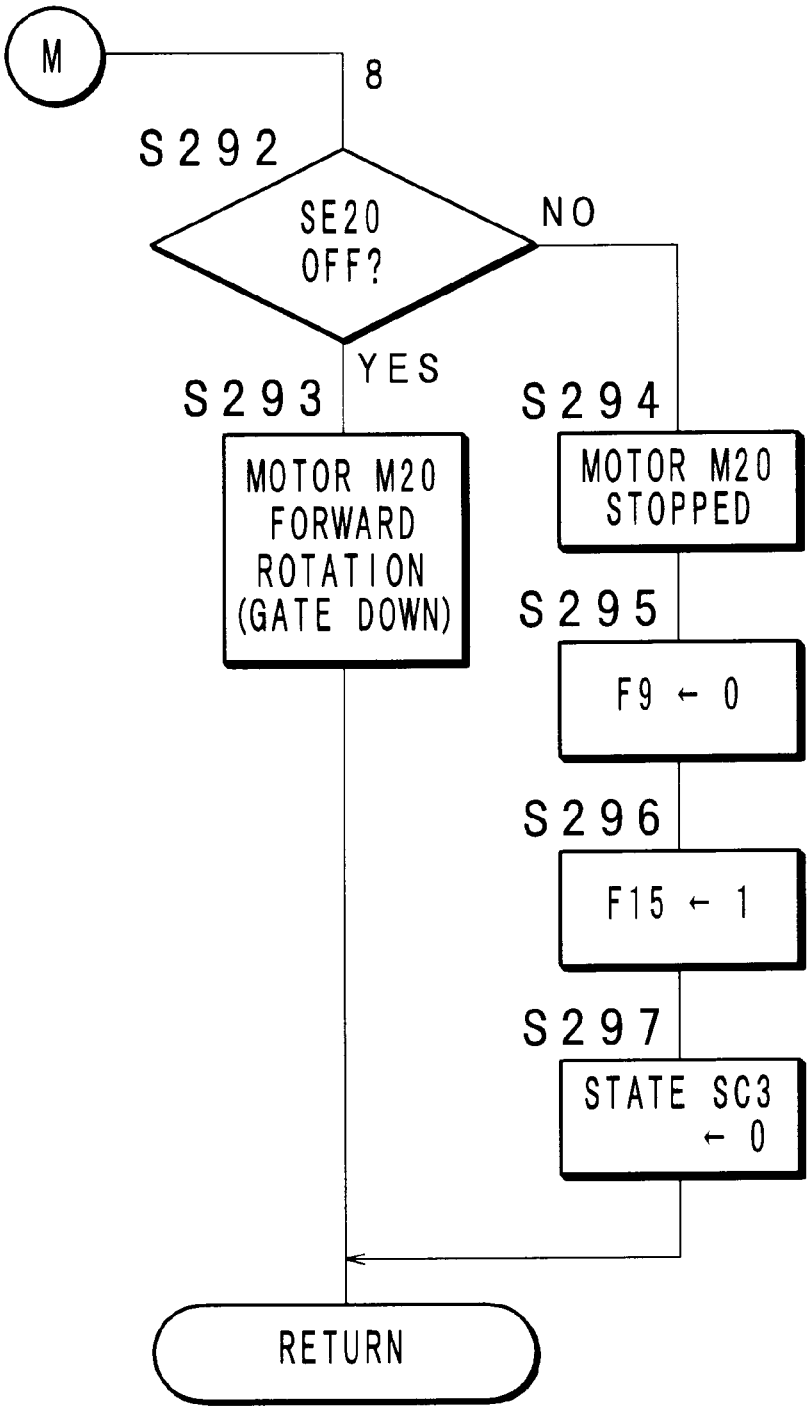

FIGS. 19*a* and 19*b* illustrate the subroutine of chucking control which is executed in the step S78. In the first place, the counted value of a state SC2 is checked in the step S200, and the following processes are then executed according to the counted value.

When the SC2 is 0, the chucking unit moving motor M30 is operated in forward direction in the step S201. The operation causes the chucking units 40 and 40*a* to move from the home position $Y_1$ to the chucking position $Y_2$. When the ON state of the sensor SE31 is verified in the step S202, i.e., when it is verified that the chucking units 40, 40*a* have reached the chucking position $Y_2$, the motor M30 is stopped in the step S203.

When it is verified in the step S204 that the take-out operation flag F9 has been set at "1" (see the steps S148 and S163), the solenoid SL30*a* is turned on in the step S205. The operation causes the upper chucking unit 40*a* to pinch the stack of sheets on the bin 31 which has been set at the level $X_3$. When it is verified in the step S206 that the chucking flag F6 has been set at "1" (see the steps S121, S129, and S139), the solenoid SL30 is turned on in the step S207. The operation causes the lower chucking unit 40 to pinch the stack of sheets on the bin 31 which has been set at the level $X_1$. After that, the state SC2 is set at 1 in the step S208.

When the SC2 is 1, the motor M30 is operated in forward direction in the step S209. The operation causes the chucking units 40 and 40*a* to move from the chucking position $Y_2$ to the pull-out position $Y_3$. When the ON state of the sensor SE32 is verified in the step S210, i.e., when it is verified that the chucking units 40 and 40*a* have reached the pull-out position $Y_3$, the motor M30 is stopped in the step S211. The solenoid SL30*a* is then turned off in the step S212. The operation causes the pinch of the stack of sheets by the upper chucking unit 40*a* to be released, and the stack of sheets is transferred to the sheet conveyer gate 100. At this time, the lower chucking unit 40 does not release the pinch of the stack of sheets, so that the stapling process is executed by the staple unit 70 with the stack of sheets pinched at the pull-out position $Y_3$ (see the step S215).

In the step S213, whether the chucking flag F6 is "0" or not is checked. If the chucking flag F6 has been reset to "0," the state SC2 is set at 4 in the step S214. If the chucking flag F6 has been set at "1," the staple unit operation flag F8 is set at "1" in the step S215, and the state SC2 is set at 2 in the step S216. Setting the flag F8 at "1" in the step S215 causes the staple unit 70 to start in the step S80 and to staple the stack of sheets.

When the state SC2 is 2, whether the staple unit operation flag F8 is "0" or not is checked in the step S217. Though it is not shown in the flowchart, the flag F8 is reset to "0" after the completion of the stapling process in the subroutine of the step S80. Accordingly, when the stapling process is completed (the result of the step S217 is YES) in this routine, the motor M30 is operated in reverse direction in the step S218. With the operation, the chucking unit 40 moves toward the chucking position $Y_2$ while pinching the stapled stack of sheets. When it is verified in the step S219 that the chucking position sensor SE31 has been turned on, the motor M30 is stopped in the step S220, and the solenoid SL30 is turned off in the step S221. The operations cause the chucking unit 40 to release the stapled stack of sheets at the chucking position $Y_2$. After that, the chucking flag F6 is reset to "0" in the step S222, and the state SC2 is set at 3 in the step S223.

When the state SC2 is 3, the motor M30 is operated in reverse direction in the step S224. The operation causes the chucking unit 40 to move toward the home position $Y_1$ (together with the chucking unit 40*a*). When it is verified in the step S225 that the home position sensor SE30 has been turned on, the motor M30 is stopped in the step S226. Subsequently, the chucking unit operation flag F7 is reset to "0" in the step S227, and the state SC2 is reset to 0 in the step S228.

When the state SC2 is 4, i.e., in the case that only the process of taking a stack of sheets out of the bin 31 positioned at the level $X_3$ is executed, whether the sensor SE22 is in ON state or not is checked in the step S229. The ON state of the sensor SE22 for detecting the presence or absence of a stack of sheets in the sheet conveyer gate 100 means that a stapled stack of sheets has been taken out of a bin 31 into the gate 100. When the sensor SE22 is ON, the state SC2 is therefore set at 3 in the step S230. Subsequently, the steps S224 through S228 are executed, so that the chucking unit 40*a* returns to the home position $Y_1$ (together with the chucking unit 40).

FIGS. 20*a*–20*e* illustrate the subroutine of gate control which is executed in the step S82. In the first place, the counted value of a state SC3 is checked in the step S240, and the following processes are then executed according to the counted value.

When the state SC3 is 0, the travel summation counter E is reset to 0 in the step S241 and whether the sensor SE33 is in ON state or not is checked in the step S242. If the sensor SE33 for detecting the presence or absence of sheets on the non-sort tray 20 is ON (i.e., if any sheets are stacked on the tray 20), the state SC3 is set at 1 in the step S243. If the sensor SE33 is OFF (i.e., if the tray 20 is empty), the total travel counter G is set at the value "E+F" wherein E is the value of the travel summation counter and F is the value of the travel constant counter, in the step S244. After that, the state SC3 is set at 2 in the step S245.

When the state SC3 is 1, whether the sensor SE23 is in ON state or not is checked in the step S246. If the sensor SE23 for detecting the uppermost surface of the sheets on the non-sort tray 20 is ON, the gate moving motor M20 is operated in reverse direction in the step S247, and the sheet conveyer gate 100 is thereby elevated. In the step S248, "1" is added to the travel summation counter E. The addition to the counter E thus continues, according to the revolution of the motor M20. When the sensor SE23 is turned off, the motor M20 is stopped in the step S249, and the total travel counter G is set at the value "E+F" in the step S250. The state SC3 is then set at 2 in the step S251, and the distance by which the gate 100 is to be lowered is thus determined.

When the state SC3 is 2 and it is judged in the step S252 that the total travel counter G is not 0, the motor M20 is operated in forward direction in the step S253, and the gate 100 is thereby lowered. In the step S254, "1" is subtracted from the total travel counter G. The subtraction from the counter G thus continues, according to the revolution of the motor M20. When it is verified that the subtraction has brought the counter G to 0 (i.e., when the result of the step S252 is NO), the motor M20 is stopped in the step S255. After it is verified in the step S256 that one of the bins 31 has been set at the level $X_3$, the state SC3 is set at 3 in the step S257. In the step S258, the truth or falsity of the expression "H<C" is checked. If "H<C" is true, i.e., if any stacks of sheets which have been stapled still remain on the bins 31, the chucking flag F6 and the chucking unit operation flag F7 are set at "1" in the step S259. If "H<C" is false, i.e., if all the stacks of sheets which have been stapled have been taken out of the bins 31, the chucking unit operation flag F7 is set at "1" in the step S260.

When the state SC3 is 3, whether the sensor SE21 is in ON state or not is checked in the step S261. The sensor SE21 is provided for detecting a stack of sheets at the position immediately before the gate 100. If the sensor SE21 is ON, i.e., if a stack of sheets has been taken out of the bin 31 positioned at the level $X_3$ and has been inserted between the rollers 102 and 103, the state SC3 is set at 4 in the step S262.

When the state SC3 is 4, the roller driving motor M21 is operated in forward direction in the step S263. With this operation, the rollers 102 and 103 rotate in forward direction to take the stack of sheets out of the bin 31. When the off-edge state of the sensor SE21 is verified in the step S264, i.e., after the stack of sheets is completely taken out by the gate 100, the motor M21 is stopped in the step S265. In the step S266, the value of the travel correction counter P is added to the travel summation counter E. The value of the counter P has been set to be equal to the thickness of the stack of sheets. In the step S267, the total travel counter G is set at the value "E+F"; the state SC3 is set at 5 in the step S268.

When the state SC3 is 5 and it is judged in the step S269 that the total travel counter G is not 0, the gate moving motor M20 is operated in reverse direction in the step S270, thereby elevating the gate 100. In the step S271, "1" is subtracted from the counter G. The subtraction from the counter G thus continues, according to the revolution of the motor M20. When it is verified that the subtraction has brought the counter G to 0 (i.e., when the result of the step S269 is NO), the motor M20 is stopped in the step S272. After that, the state SC3 is set at 6 in the step S273.

When the state SC3 is 6, the roller driving motor M21 is operated in reverse direction in the step S274. With this operation, the rollers 102 and 103 rotate in reverse direction to eject the stack of sheets onto the non-sort tray 20. When the off-edge state of the sensor SE22 is verified in the step S275, i.e., after the stack of sheets is ejected from the gate 100, the motor M21 is stopped in the step S276. In the step S277, "1" is subtracted from the take-out bin counter D for the bins to be emptied; the state SC3 is set at 7 in the step S278.

When the state SC3 is 7, whether the take-out bin counter D for the bins to be emptied stands at 0 or not is checked in the step S279. If the counter D stands at 0, whether the sort flag F1 is "1" or not is checked in the step S280. If the sort flag F1 has been set at "1," the truth or falsity of the expression "A>20B" is judged in the step S281. If the expression "A>20B" is true, i.e., if copies are to be made subsequently, the total travel counter G is set at the value "E+F" in the step S285. After that, the one-bin take-out completion flag F15 is set at "1" in the step S286 and the take-out operation flag F9 is reset to "0" in the step S287. In the step S288, the state SC3 is set at 2. If the expression "A>20B" is false (the result of the step S281 is NO), i.e., if the number of the copies which have been made has reached the registered number which has been established, the state SC3 is set at 8 in the step S282.

In the case of the group mode (i.e., if the result of the step S280 is NO), the presence or absence of the index document is checked in the step S283 (see the step S175). In the presence of the index document, the steps S285 through S288 are executed because the copying operation will be continued. In the absence of the index document, the state SC3 is set at 8 in the step S284.

If the take-out bin counter D for the bins to be emptied does not stand at 0, the total travel counter G is set at the value "E+F" in the step S289 so that the next stack of sheets is taken out. After that, the one-bin take-out completion flag F15 is set at "1" in the step S290, and the state SC3 is set at 2 in the step S291.

When the state SC3 is 8, the gate 100 is returned to its home position. That is, if the OFF state of the home position sensor SE20 is verified in the step S292, the gate moving motor M20 is operated in forward direction in the step S293, and the gate 100 is thereby lowered. When the sensor SE20 is turned on (i.e., if the result of the step S292 is NO), the motor M20 is stopped in the step S294. After that, the take-out operation flag F9 is reset to "0" in the step S295, and the one-bin take-out completion flag F15 is set at "1" in the step S296. Subsequently, the state SC3 is reset to "0" in the step S297.

Figure 21:
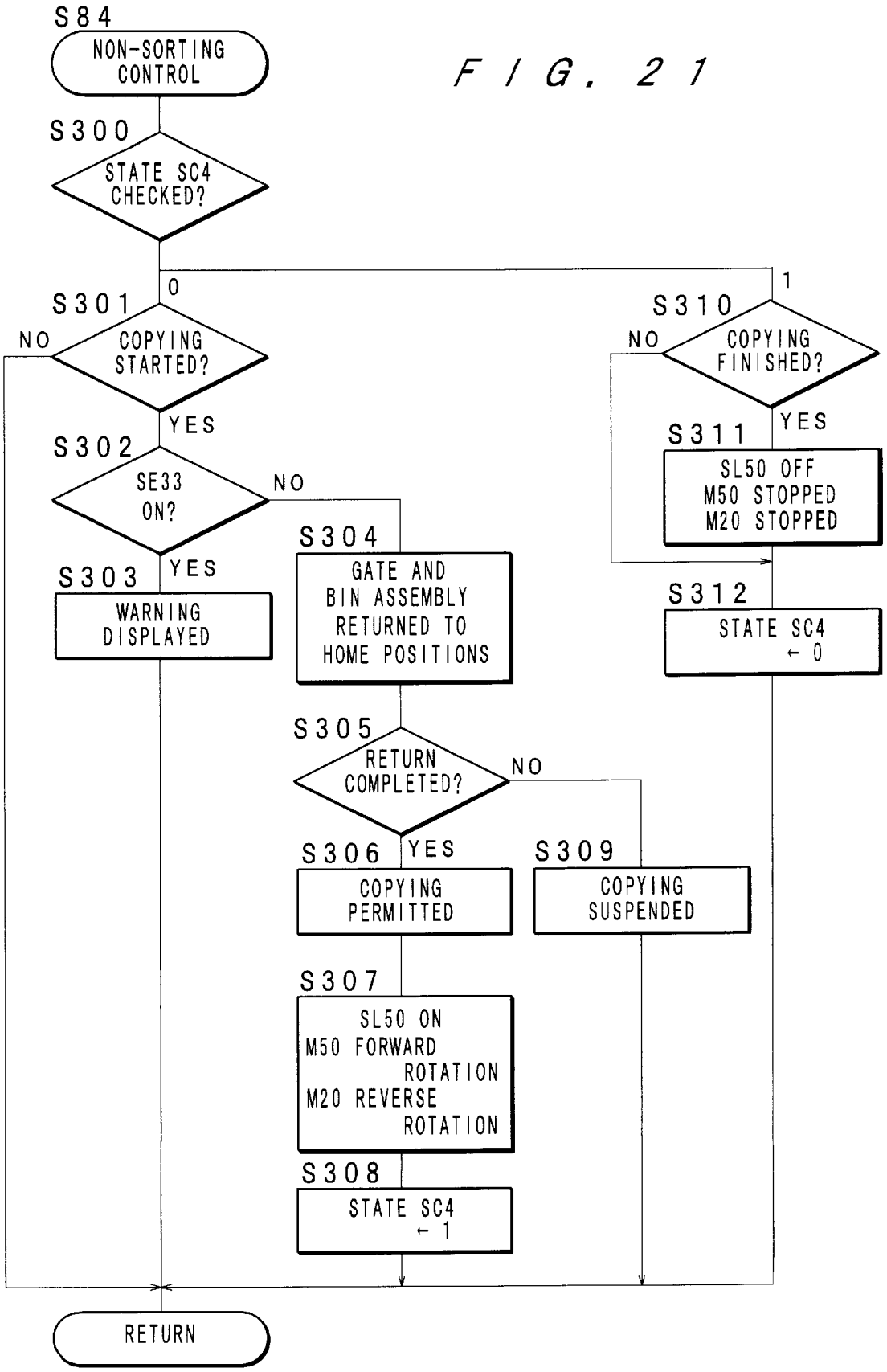
FIG. 21 is a flowchart illustrating a subroutine of non-sort process.

FIG. 21 illustrates the subroutine of non-sorting control which is executed in the step S84. In the first place, the counted value of a state SC4 is checked in the step S300, and the following processes are then executed according to the counted value.

When the state SC4 is 0 and the start of a copying operation is verified in the step S301, whether the sensor SE33 is in ON state or not is checked in the step S302. If the sensor SE33 is ON, a warning message which indicates that sheets have been stored on the non-sort tray 20 is displayed on the touch panel in the step S303. When the non-sort tray 20 is emptied (i.e., when the result of the step S302 is NO), the gate 100 and the bin assembly 30 are returned to their home positions in the step S304. When the return to the home positions is verified in the step S305, a permission to perform copying operation is granted in the step S306. In the step S307, the solenoid SL5O is turned on, and the forward operation of the conveyer motor M50 and the reverse operation of the roller driving motor M20 are effected. With the operations, the diverter 82 is set in the position for guiding a sheet to the non-sort tray 20, so that a sheet ejected from the copying machine 1 is directly delivered onto the non-sort tray 20. After that, the state SC4 is set at 1 in the step S308. Until the gate 100 and the bin assembly 30 reach their home positions (if the result of the step S305 is NO), the copying operation is suspended in the step S309.

When the state SC4 is 1 and the completion of all the copying operation is verified in the step S310, the solenoid SL50 is turned off, and the motors M50 and M20 are stopped in the step S311. After that, the state SC4 is reset to 0 in the step S312.

The finisher in accordance with the present invention is not limited to the above embodiment but various changes and modifications may be made within the spirit and scope of the invention.

The present invention, in particular, may be applied to a staple sorter connected to a printer which outputs image information transferred from a host computer as a hard copy, other than to the copying machine 1.

In addition, the bin assembly 30 and the sheet conveyer section 80 can be arbitrarily structured. For example, if the finisher is attached to a copying machine or a printer of a type which has an image memory function and reads out and forms images in order of page to make a desired number of sets of copies, the finisher may be provided with only one bin 31. A staple bin exclusively used for stapling may be provided in addition to sort bins.

The present invention may be applied to a finisher which has not only a stapling function but also a function of binding a stack of sheets by a clip, metal fittings or glue.

What is claimed is:

1. A finisher which stacks sheets ejected from an image forming apparatus and processes the stacked sheets, the finisher comprising:

a process tray on which sheets are stacked to undergo processing;

a stack section which is provided above the process tray to store sheets;

sheet stack conveying means provided adjacent to an entrance of the process tray and vertically movable to take a processed stack of sheets out of the process tray and convey the processed stack of sheets to the stack section; and a sheet conveying member structured such that it can selectively transfer single sheets ejected from the image forming apparatus into said stack section, as well as into said process tray without displacing said sheet conveying member relative to said process tray or said stack section.

2. A finisher as claimed in claim 1, wherein said processing includes stapling.

3. A finisher as claimed in claim 1, wherein said processing includes binding.

4. A finisher as claimed in claim 1, wherein the sheet stack conveying means has a pair of rollers which are capable of rotating forward, rotating in reverse, and stopping.

5. A finisher as claimed in claim 1, wherein the sheet conveying member retreats from the entrance of the process tray when the sheet stack conveying means takes a processed stack of sheets out of the process tray.

6. A finisher which stacks sheets ejected from an image forming apparatus and processes the stacked sheets, the finisher comprising:

a process tray on which sheets are stacked to undergo processing;

a non-sort tray on which sheets not to undergo processing are stacked and on which a processed stack of sheets is stored;

sheet stack conveying means movable between the process tray and the non-sort tray, the sheet stack conveying means conveying sheets into the non-sort tray one by one during operation in a non-sort mode and taking said processed stack of sheets out of the process tray into the non-sort tray during operation in a process mode; and a sheet conveying member structured such that it can selectively transfer single sheet ejected from the image forming apparatus into said non-sort tray, as well as into said process tray without displacing said sheet stack conveying means relative to said process tray or said non-sort tray.

7. A finisher as claimed in claim 6, wherein said processing includes stapling.

8. A finisher as claimed in claim 6, wherein the sheet conveying means has a pair of rollers which are capable of rotating forward, rotating in reverse, and stopping.

9. A finisher which stacks sheets ejected from an image forming apparatus and staples the stacked sheets ejected from an image forming apparatus and staples the stacked sheets, the finisher comprising:

a staple tray on which sheets are stacked to undergo stapling;

a stapler which staples a stack of sheets at a trailing portion of the stack with respect to a direction in which the sheets are conveyed into the staple tray;

a stack section which is provided above the staple tray to store sheets;

a sheet stack conveying means which is provided adjacent to an entrance of the staple tray and is vertically moveable to take up the stapled stack of sheets out of the staple tray and take the stack of sheets into the stack section with its unstapled end as a leading end; and a sheet conveying member structured such that it can selectively transfer single sheets elected from the image forming apparatus into said stack section, as well as into said staple tray without displacing said sheet conveying member relative to said staple tray or said stack section.

10. A finisher as claimed in claim 9, wherein the sheet stack conveying means has a pair of rollers which are capable of rotating forward, rotating in reverse, and stopping.

11. A finisher as claimed in claim 9, wherein the sheet conveying member retreats from the entrance of the staple tray when the sheet stack conveying means takes a stapled stack of sheets out of the staple tray.

12. A finisher which stacks sheets ejected from an image forming apparatus and staples the stacked sheets ejected from an image forming apparatus and staples the stacked sheets, the finisher comprising:

a staple tray on which sheets are stacked to undergo stapling;

a stapler which staples a stack of sheets at a trailing portion of the stack with respect to a direction in which the sheets are conveyed into the staple tray;

a stack section which is provided above the staple tray to store sheets;

a sheet stack conveying means which is provided adjacent to an entrance of the staple tray and is vertically moveable to take up the stapled stack of sheets out of the staple tray with its stapled end as a leading end and convey the stack of sheets into the stack section; and a sheet conveying member structured such that it can selectively transfer single sheets ejected from the image forming apparatus into said stack section, as well as into said staple tray without displacing said sheet conveying member relative to said staple tray or said stack section.

13. A finisher as claimed in claim 12, wherein the sheet stack conveying means has a pair of rollers which are capable of rotating forward, rotating in reverse, and stopping.

14. A finisher as claimed in claim 9, wherein when the sheet conveying means takes a stapled stack of sheets out of the staple tray, the sheet conveying member retreats from the entrance of the staple tray.

15. A finisher as claimed in claim 1, wherein said conveying member comprises a first conveyer section, a second conveyer section, and a pivotable diverter for alternately directing sheets ejected from an image forming apparatus into said first and second conveyer sections.

16. A finisher as claimed in claim 1, wherein said conveying means has a home position wherein individual sheets can be delivered by said sheet conveying member into said stack section through a gate in said sheet conveying means.

17. A finisher as claimed in claim 9, wherein said conveying member comprises a first conveyer section, a second conveyer section, and a pivotable diverter for alternately directing sheets ejected from an image forming apparatus into said first and second conveyer sections.

18. A finisher as claimed in claim 9, wherein said conveying means has a home position wherein individual sheets can be delivered by said sheet conveying member into said stack section through a gate in said sheet conveying means.

19. A finisher as claimed in claim 12, wherein said conveying member comprises a first conveyer section, a second conveyer section, and a pivotable diverter for alternately directing sheets ejected from an image forming apparatus into said first and second conveyer sections.

20. A finisher as claimed in claim 12, wherein said conveying means has a home position wherein individual sheets can be delivered by said sheet conveying member into said stack section through a gate in said sheet conveying means.

* * * * *

UNITED STATES PATENT AND TRADEMARK OFFICE

CERTIFICATE OF CORRECTION

PATENT NO. : 5,971,383

DATED : October 26, 1999

INVENTOR(S) : Masayoshi HORIKAWA et al

It is certified that error appears in the above-indentified patent and that said Letters Patent is hereby corrected as shown below:

In Column 19, line 59, delete "elected" and insert -- ejected --.

Signed and Sealed this

Twenty-first Day of November, 2000

*Attest:*

Q. TODD DICKINSON

*Attesting Officer*

*Director of Patents and Trademarks*